US007624468B2

(12) United States Patent
Reddy et al.

(10) Patent No.: US 7,624,468 B2
(45) Date of Patent: Dec. 1, 2009

(54) WET MOP WITH MULTI-LAYER SUBSTRATE

(75) Inventors: Kiran K. Reddy, Roswell, GA (US); Sridhar Ranganathan, Suwanee, GA (US); Joseph K. Baker, Suwanee, GA (US); Cameron Ray Morris, Cumming, GA (US); Stephanie Ann Rossignol, Cumming, GA (US); Andrew Clement, Alpharetta, GA (US); George Nukuto, Neenah, WI (US); Denis R. Grimard, Appleton, WI (US); Carl G. Rippl, Appleton, WI (US); MeeWha Lee, Appleton, WI (US); Paul Woon, Alpharetta, GA (US); Russell J. Kroll, Atlanta, GA (US); Mark Londborg, Atlanta, GA (US); Robert Henshaw, Newnan, GA (US); Fred Robert Radwanski, Stone Mountain, GA (US); Charles Wilson Colman, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 16 days.

(21) Appl. No.: 11/458,110

(22) Filed: Jul. 18, 2006

(65) Prior Publication Data

US 2008/0016640 A1 Jan. 24, 2008

(51) Int. Cl.

| | |
|---|---|
| ***A47L 13/44*** | (2006.01) |
| ***A47L 13/10*** | (2006.01) |
| ***A47L 13/20*** | (2006.01) |
| ***A47L 13/17*** | (2006.01) |

(52) U.S. Cl. ..... 15/104.94; 15/104.93; 15/208; 15/228; 15/229.1; 15/229.2; 15/209.1

(58) Field of Classification Search ..... 15/228, 15/229.1, 229.2, 229.3, 147.1, 208, 209.1, 15/210.1, 104.93, 104.94; 156/250, 269
See application file for complete search history.

(56) References Cited

U.S. PATENT DOCUMENTS

| | | | |
|---|---|---|---|
| 1,076,800 | A | 10/1913 | Waymire |
| 1,245,990 | A | 11/1917 | Shannahan |
| 1,605,008 | A | 11/1926 | Smith |
| 2,320,372 | A | 6/1943 | McCarthy |

(Continued)

FOREIGN PATENT DOCUMENTS

| | | | |
|---|---|---|---|
| DE | 19908259 | A1 | 8/2000 |

(Continued)

OTHER PUBLICATIONS

Patent Abstracts of Japan, JP 2002102132A, Apr. 9, 2002, Kondo et al.

(Continued)

*Primary Examiner*—Gary K Graham
(74) *Attorney, Agent, or Firm*—Nathan P. Hendon

(57) ABSTRACT

A wet mop head assembly for use with a mop handle is disclosed. The mop head includes a laminate mop substrate having a first layer of scrubbing material, a second layer of scrubbing material and an absorbent foam layer sandwiched between the scrubbing material layers. At least one bond is present to join the scrubbing and absorbent foam layers together.

18 Claims, 8 Drawing Sheets

U.S. PATENT DOCUMENTS 2,328,287 A 8/1943 Martin
2,530,250 A 11/1950 Leith
2,724,852 A 11/1955 Clark
2,900,652 A 8/1959 Kautenberg
3,208,318 A 9/1965 Roberts
3,395,415 A 8/1968 Leland
3,485,706 A 12/1969 Evans
3,605,161 A 9/1971 Moss et al.
3,650,995 A 3/1972 Erickson
3,669,103 A 6/1972 Harper et al.
3,692,618 A 9/1972 Dorschner et al.
3,753,267 A 8/1973 Johnson, Sr.
3,827,099 A 8/1974 Allaire et al.
3,849,241 A 11/1974 Butin et al.
3,849,825 A 11/1974 Shortte, Jr.
3,900,030 A 8/1975 Bashan
4,041,203 A 8/1977 Brock et al.
4,100,324 A 7/1978 Anderson et al.
4,114,223 A 9/1978 Buchanan
4,114,224 A 9/1978 Disko
4,133,784 A 1/1979 Otey et al.
4,174,415 A 11/1979 Bethe
4,196,488 A 4/1980 Barry
4,205,103 A 5/1980 Davis et al.
4,247,216 A 1/1981 Pansini
4,288,884 A 9/1981 Bahls
4,306,326 A 12/1981 Kim
4,313,774 A 2/1982 Arthur
4,337,181 A 6/1982 Otey et al.
4,340,563 A 7/1982 Appel et al.
4,433,931 A 2/1984 Malish et al.
4,441,228 A 4/1984 Marquart et al.
4,454,268 A 6/1984 Otey et al.
4,523,347 A 6/1985 Tames
D281,361 S 11/1985 Jaros et al.
4,601,938 A 7/1986 Deacon et al.
4,604,313 A 8/1986 McFarland et al.
4,717,738 A 1/1988 Fukuda et al.
4,725,629 A 2/1988 Garvey et al.
4,731,391 A 3/1988 Garvey
4,818,464 A 4/1989 Lau
4,819,293 A 4/1989 Nicholson
4,820,577 A 4/1989 Morman et al.
4,923,738 A 5/1990 Newell
4,950,526 A 8/1990 Singleton
4,961,242 A 10/1990 Kresse et al.
4,962,682 A 10/1990 Rose et al.
4,964,186 A 10/1990 Stuck
4,985,467 A 1/1991 Kelly et al.
4,995,133 A 2/1991 Newell
4,995,134 A 2/1991 Monahan
5,011,864 A 4/1991 Nielsen et al.
5,027,468 A 7/1991 Leventhal et al.
5,066,527 A 11/1991 Newell
5,110,843 A 5/1992 Bries et al.
5,145,727 A 9/1992 Potts et al.
5,169,706 A 12/1992 Collier, IV et al.
5,178,931 A 1/1993 Perkins et al.
5,188,885 A 2/1993 Timmons et al.
5,207,754 A 5/1993 Harrah
5,217,787 A 6/1993 Monahan
5,221,124 A * 6/1993 Nichols ..... 300/21
5,227,228 A 7/1993 Newell
5,230,596 A 7/1993 Morad
5,284,703 A 2/1994 Everhart et al.
5,288,161 A 2/1994 Graves et al.
5,345,643 A 9/1994 Tomm
5,350,624 A 9/1994 Georger et al.
5,375,286 A 12/1994 Harrah
5,389,202 A 2/1995 Everhart et al.
5,390,390 A 2/1995 Kresse et al.
5,394,594 A 3/1995 Duran
D362,938 S 10/1995 Williams et al.
D375,391 S 11/1996 Williams et al.
5,581,839 A 12/1996 Ferrell, Jr.
5,587,225 A 12/1996 Griesbach et al.
5,638,569 A 6/1997 Newell
5,701,628 A 12/1997 Morad
5,706,544 A 1/1998 Young
5,750,585 A 5/1998 Park et al.
5,826,421 A 10/1998 Wilcox et al.
5,842,810 A 12/1998 Morad
5,884,355 A 3/1999 DeGuzman
5,901,402 A 5/1999 Williams
5,911,258 A 6/1999 Morad
5,920,944 A 7/1999 Biggs et al.
5,937,471 A 8/1999 Liao
5,970,567 A 10/1999 Hirse
6,008,262 A 12/1999 McKay et al.
6,022,818 A 2/2000 Welchel et al.
6,023,812 A 2/2000 Morad
6,029,308 A 2/2000 Smith
6,047,435 A 4/2000 Suzuki et al.
6,103,061 A 8/2000 Anderson et al.
6,149,767 A 11/2000 Hermans et al.
6,161,242 A * 12/2000 Cabrero Gomez et al. . 15/147.1
6,177,370 B1 1/2001 Skoog et al.
6,212,917 B1 4/2001 Rathbun
6,253,408 B1 7/2001 Feld et al.
6,331,230 B1 12/2001 Hermans et al.
6,354,666 B1 3/2002 Atkins et al.
6,481,042 B1 * 11/2002 Hsieh ..... 15/229.2
6,513,199 B1 2/2003 Cheng
6,551,980 B1 4/2003 Wisniewski et al.
6,613,732 B2 9/2003 Suazon et al.
6,624,100 B1 9/2003 Pike
6,637,065 B2 10/2003 Biggs
6,649,547 B1 11/2003 Arnold et al.
6,654,980 B2 12/2003 Biggs
6,681,434 B2 * 1/2004 Smith ..... 15/104.93
6,687,944 B2 2/2004 Young
6,692,825 B2 2/2004 Qin et al.
6,736,034 B1 5/2004 Gonzales
6,736,916 B2 5/2004 Steinke et al.
6,772,468 B1 8/2004 Psik et al.
6,777,056 B1 8/2004 Boggs et al.
6,784,126 B2 8/2004 Everhart et al.
6,797,360 B2 9/2004 Varona
6,797,377 B1 9/2004 DeLucia et al.
6,808,791 B2 10/2004 Curro et al.
6,813,801 B2 11/2004 Tanaka et al.
6,820,301 B2 11/2004 Petner
6,854,919 B2 2/2005 Neumann et al.
6,878,433 B2 4/2005 Curro et al.
6,889,917 B2 5/2005 Fahy et al.
6,910,823 B2 6/2005 Policicchio et al.
6,925,686 B2 8/2005 Heathcock et al.
6,953,299 B2 10/2005 Wang et al.
6,976,282 B2 12/2005 Sie
6,978,508 B2 12/2005 Young
6,986,618 B2 1/2006 Hall et al.
7,065,825 B2 6/2006 Minkler et al.
2001/0009632 A1 7/2001 Cross
2002/0146956 A1 10/2002 Ngai
2003/0028985 A1 2/2003 Prodoehl et al.
2003/0045197 A1 3/2003 Kakiuchi et al.
2003/0088936 A1 5/2003 Young
2003/0097725 A1 5/2003 Smith
2003/0121530 A1 7/2003 Borgonjon et al.
2003/0140441 A1 7/2003 Stafford
2003/0200991 A1 10/2003 Keck et al.
2004/0040107 A1 3/2004 Bolkan et al.
2004/0087460 A1 5/2004 Wisniewski et al.
2004/0128786 A1 7/2004 Policicchio et al.

2004/0182952 A1 9/2004 Soller et al.
2004/0188539 A1 9/2004 Soller et al.
2004/0255418 A1 12/2004 Minkler et al.
2004/0258853 A1 12/2004 Galvin et al.
2005/0000050 A1 1/2005 Galvin et al.
2005/0039287 A1 2/2005 Moser
2005/0044650 A1 3/2005 Goldberg et al.
2005/0060827 A1 3/2005 James et al.
2005/0066465 A1 3/2005 Minkler et al.
2005/0097691 A1 5/2005 Tsuchiya et al.
2005/0097695 A1 5/2005 Tanaka et al.
2005/0097696 A1 5/2005 Tanaka et al.
2005/0102781 A1 5/2005 Tsuchiya et al.
2005/0124709 A1 6/2005 Krueger et al.
2005/0132521 A1 6/2005 Tanaka et al.
2005/0136238 A1 6/2005 Lindsay et al.
2005/0177967 A1 8/2005 Tanaka et al.
2005/0228350 A1 10/2005 Ranganathan et al.
2005/0229344 A1 10/2005 Mittelstaedt et al.
2005/0251941 A1 11/2005 Berhoff
2005/0251943 A1 11/2005 VanLandingham, Jr.
2005/0265769 A1 12/2005 Blom
2005/0285387 A1 12/2005 Suda et al.
2006/0030632 A1 2/2006 Krueger et al.
2006/0048327 A1 3/2006 Lacotta et al.
2006/0068187 A1 3/2006 Krueger et al.
2006/0128247 A1 6/2006 Skoog et al.
2006/0148917 A1 7/2006 Radwanski et al.

FOREIGN PATENT DOCUMENTS

| | | | |
|---|---|---|---|
| EP | 0739600 | A1 | 10/1996 |
| EP | 1362544 | A2 | 11/2003 |
| EP | 0987097 | B1 | 11/2004 |
| FR | 2575058 | A | 6/1986 |
| GB | 2259474 | | 3/1993 |
| WO | WO 02/091900 | | 11/2002 |
| WO | WO 03/007773 | | 1/2003 |
| WO | WO 2005/084516 | | 9/2005 |
| WO | WO 2006/012926 | | 2/2006 |

OTHER PUBLICATIONS

Patent Abstracts of Japan, JP 2003111706A, Apr. 15, 2003, R. Young.
Patent Abstracts of Japan, JP 2005246088A, Sep. 15, 2005, R. Young.
ASTM Designation: D 1622-03, "Standard Test Method for Apparent Density of Rigid Cellular Plastics," Published Jan. 2004, 4 pages.
ASTM Designation: D 3575-00, "Standard Test Methods for Flexible Cellular Materials Made From Olefin Polymers," Published Nov. 2000, 9 pages
Beaumont, D.F. and Randall, K.R., "Rotary Hydraulic Entanglement of Nonwovens," *Nonwovens World*, vol. 1, No. 3, Nov. 1986, pp. 76-80.
Lawrence, K.D. et al., "An Improved Device for the Formation of Super-Fine Thermoplastic Fibers," *NRL Report 5265*, Feb. 11, 1959.
Wendt, B.A. et al., "Manufacture of Superfine Organic Fibers", *NRL Report 4364*, May 25, 1954.

* cited by examiner

WET MOP WITH MULTI-LAYER SUBSTRATE

BACKGROUND

Various versions of wet mops are available to work on surfaces such as floors. Such mops are used to absorb liquids put or spilled on such floors, sanitize or disinfect surfaces, apply protective coatings, and to clean such surfaces. One common function of such mops is to absorb liquid that is present on a surface such as a floor. Cotton string mops are commonly available and work very well at such purposes. Sponges and other synthetic materials have also been used to absorb liquids.

Another common purpose for such mops is to release a liquid substance to a surface. Sponge mops and polymeric foam mops are commonly used for such purposes as such materials are excellent at absorbing liquid into their structures and then releasing the same liquid substance when pressure is applied to the material. For example, a floor polish or wax is often applied to a floor by a sponge mop.

Scrubbing of a surface is yet another common purpose for mops. Dirt, debris, and stains on a floor are often cleaned up with a mop, usually in working cooperation with water, cleansers, degreasers, soaps, and the like. Cottons string mops work very well at scrubbing a surface and picking of dirt and debris from a floor. However, when such mops are wrung out, the cotton string mop retains some dirt within its structure and appears dirty, even after its first rinsing dunk in the rinse bucket.

Sponges and polymeric foams do not work as well for scrubbing purposes, as they have very little scrub resistance; upon scrubbing, pieces of the sponge are often torn from or otherwise break apart from the sponge. Similarly, polymeric foam mops have excellent absorbency and liquid release, but have the same issues of low abrasion resistance as typical sponge mops. Such poor abrasion resistance results in replacement of such mop substrates on a regular basis and may require additional cleaning of mop pieces that have broken off of the substrate. Some have tried to address this problem by coating such sponges with latex texturing to improve the scrub resistance.

Another issue with cotton strip mops or other such mops is with release of active components from cleansers, disinfectants and sanitizers. One common active ingredient in many disinfectants are quaternary ammonium chlorides, which are commonly referred to as "quats". The problem is that a substrate may deplete 10-60% of the active quat from the disinfectant, depending on the materials making up the construction of the substrate. The active quats are adsorbed on to the surface of the substrate. For example, a cotton substrate can deplete 60% from active quat from a quat-based disinfectant solution introduced to such a substrate. This reduction of active quats in a disinfectant solution decreases the effectiveness of the solution to kill harmful micro-organisms.

Many sponge and polymeric foam mops do a better job of releasing such active ingredients back to the surface being cleaned rather than adsorbing the active ingredients upon the surface of the substrate. However, as already mentioned, sponge and polymeric foam mops have lower abrasion resistance than most cotton string or other fibrous mops.

Definitions

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "couple" includes, but is not limited to, joining, connecting, fastening, linking, or associating two things integrally or interstitially together.

As used herein, the term "configure(s)", "configured" or "configuration(s)" means to design, arrange, set up, or shape with a view to specific applications or uses. For example: a military vehicle that was configured for rough terrain; configured the computer by setting the system's parameters.

As used here, the term "operable" or "operably" means being in a configuration such that use or operation is possible. Similarly, "operably connect(s)" or "operably connected" refers to the relation of elements being so configured that a use or an operation is possible through their cooperation. For example: the machine is operable; the wheel is operably connected to the axle.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As user herein, the terms "orientation" or "position" used interchangeably herein refer to the spatial property of a place where or way in which something is situated; for example, "the position of the hands on the clock."

As used herein, the term "cell" refers to a cavity contained in foam. A cell is closed when the cell membrane surrounding the cavity or enclosed opening is not perforated and has all membranes intact. Cell connectivity occurs when at least one wall of the cell membrane surrounding the cavity has orifices or pores that connect to adjacent cells, such that an exchange of fluid is possible between adjacent cells.

As used herein, the term "compression" refers to the process or result of pressing by applying force on an object, thereby increasing the density of the object.

As used herein, the term "elastomer" refers to material having elastomeric or rubbery properties. Elastomeric materials, such as thermoplastic elastomers, are generally capable of recovering their shape after deformation when the deforming force is removed. Specifically, as used herein, elastomeric is meant to be that property of any material which upon application of an elongating force, permits that material to be stretchable to a stretched length which is at least about 25 percent greater than its relaxed length, and that will cause the material to recover at least 40 percent of its elongation upon release of the stretching elongating force. A hypothetical example which would satisfy this definition of an elastomeric material in the X-Y planar dimensions would be a one (1) inch (2.54 cm) sample of a material which is elongatable to at least 1.25 inches (3.18 cm) and which, upon being elongated to 1.25 inches (3.18 cm) and released, will recover to a length of not more than 1.15 inches (2.92 cm). Many elastomeric materials may be stretched by much more than 25 percent of their relaxed length, and many of these will recover to substantially their original relaxed length upon release of the stretching, elongating force. In addition to a material being elastomeric in the described X-Y planar dimensions of a structure, including a web or sheet, the material can be elastomeric in the Z planar dimension. Specifically, when a structure is applied compression, it displays elastomeric properties and will essentially recover to its original position upon relaxation. Compression set is sometimes used to describe such elastic recovery.

As used herein, the term "open cell" refers to any cell that has at least one broken or missing membrane or a hole in a membrane.

As used herein, the term "plasticizing agent" refers to a chemical agent that can be added to a rigid polymer to add flexibility to rigid polymers. Plasticizing agents typically lower the glass transition temperature.

As used herein, the term "polymer" generally includes but is not limited to, homopolymers, copolymers, including block, graft, random and alternating copolymers, terpolymers, etc., and blends and modifications thereof. Furthermore, unless otherwise specifically limited, the term "polymer" shall include all possible molecular geometrical configurations of the material. These configurations include, but are not limited to isotactic, syndiotactic and atactic symmetries.

As used herein, the term "surfactant" is a compound, such as detergents and wetting agents, that affects the surface tension of fluids.

As used herein, the term "thermoplastic" is meant to describe a material that softens and/or flows when exposed to heat and which substantially returns to its original hardened condition when cooled to room temperature.

As used herein the terms "nonwoven fabric", "nonwoven material", or "nonwoven web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter ($g/m^2$ or gsm) and the fiber diameters useful are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 25 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($152\times 0.89\times 0.00707=1.415$). Outside the United States the unit of measurement is more commonly the "tex", which is defined as the grams per kilometer of fiber. Tex may be calculated as denier/9.

As used herein, the term "spunbond", "spunbonded", and "spunbonded filaments" refers to small diameter continuous filaments which are formed by extruding a molten thermoplastic material as filaments from a plurality of fine, usually circular, capillaries of a spinnerette with the diameter of the extruded filaments then being rapidly reduced as by, for example, eductive drawing and/or other well-known spunbonding mechanisms. The production of spunbonded nonwoven webs is illustrated in patents such as, for example, in U.S. Pat. No. 4,340,563 to Appel et al., and U.S. Pat. No. 3,692,618 to Dorschner et al. The disclosures of these patents are hereby incorporated by reference.

As used herein the term "meltblown" means fibers formed by extruding a molten thermoplastic material through a plurality of fine, usually circular die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, in various patents and publications, including NRL Report 4364, "Manufacture of Super-Fine Organic Fibers" by B. A. Wendt, E. L. Boone and D. D. Fluharty; NRL Report 5265, "An Improved Device For The Formation of Super-Fine Thermoplastic Fibers" by K. D. Lawrence, R. T. Lukas, J. A. Young; and U.S. Pat. No. 3,849,241, issued Nov. 19, 1974, to Butin, et al.

As used herein, the term "bonded carded webs" refers to webs that are made from staple fibers which are usually purchased in bales. The bales are placed in a fiberizing unit/picker which separates the fibers. Next, the fibers are sent through a combining or carding unit which further breaks apart and aligns the staple fibers in the machine direction so as to form a machine direction-oriented fibrous non-woven web. Once the web has been formed, it is then bonded by one or more of several bonding methods. One bonding method is powder bonding wherein a powdered adhesive is distributed throughout the web and then activated, usually by heating the web and adhesive with hot air. Another bonding method is pattern bonding wherein heated calender rolls or ultrasonic bonding equipment is used to bond the fibers together, usually in a localized bond pattern through the web and or alternatively the web may be bonded across its entire surface if so desired. When using bi-component staple fibers, through-air bonding equipment is, for many applications, especially advantageous.

As used herein "multilayer laminate" means a laminate wherein one or more of the layers may be spunbond and/or meltblown such as a spunbond/meltblown/spunbond (SMS) laminate and others as disclosed in U.S. Pat. No. 4,041,203 to Brock et al., U.S. Pat. No. 5,169,706 to Collier, et al, U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.40 to about 3 osy. Multilayer laminates for many applications also have one or more film layers which may take many different configurations and may include other materials like foams, tissues, woven or knitted webs and the like.

As used herein, the term "continuous filaments", refers to strands of continuously formed polymeric filaments having a length to diameter ratio of at least about a thousand and usually much higher. Such filaments will typically be formed by extruding molten material through a die head having a certain type and arrangement of capillary holes therein.

As used herein, the term "staple fiber", refers to a fiber that has been formed or cut to a staple lengths of generally 20 centimeters or less.

The term "pulp" as used herein refers to fibers from natural sources such as woody and non-woody plants. Woody plants include, for example, deciduous and coniferous trees. Non-woody plants include, for example, cotton, flax, esparto grass, milkweed, straw, jute hemp, and bagasse.

These terms may be defined with additional language in the remaining portions of the specification.

SUMMARY OF THE INVENTION

In light of the problems and issues discussed above, it is desired to have a wet mop substrate that has excellent absorptive and scrub resistant characteristics.

The present invention is directed to a wet mop head assembly than may be used with a mop handle. The mop head includes a laminate mop substrate coupled to a head mount, where the head mount may be used to couple to a mop handle. The laminate mop substrate includes a first layer of scrubbing material, a second layer of scrubbing material and an absorbent foam layer sandwiched between the scrubbing material layers. At least one bond is present to join the scrubbing and absorbent foam layers together.

In some embodiments, the laminate mop substrate includes a sheet having a pair of opposed end edges, a pair of opposed side edges, a mounting section extending transversely across the sheet between opposed side edges and positioned centrally between the opposed end edges, and a plurality of substrate strips positioned on both sides of the mounting section and extending from the mounting section. Each of such substrate strips have a pair of opposed strip side edges and a strip free-end edge. The plurality of substrate strips are positioned next to each other and aligned side by side along the substrate side edges. The first layer of scrubbing material, the absorbent foam layer, and the second layer of scrubbing material of each of the plurality of substrate strips are joined together by at least one bond on each of the plurality of substrate strips. Finally, the head mount of the mop head is coupled to the mounting section of the sheet.

In other embodiments, the laminate mop substrate includes a plurality of individual substrate strips. Each of the strips includes a pair of opposed strip side edges, a pair of opposed strip end edges, and a mounting aperture positioned centrally between the opposed strip edges. The first and second layers of scrubbing material and the absorbent foam layer sandwiched therebetween are joined together by at least one bond on each of the plurality of substrate strips. Finally, the head mount of the mop head is coupled to the mounting aperture of each of the plurality of substrate strips.

In various embodiments, the bond(s) joining the first and second layer of scrubbing material and the absorbent foam layer may be positioned along the center of the substrate strips, between the strip side edges. In other embodiments, the bond(s) joining such layers may be positioned along the strip side edges of the substrate strips. In further embodiments, the mop head may include substrate strips having bond(s) joining the layers along the center of the substrate strip and other substrate strips having bond(s) joining the layers along the strip side edges.

In various embodiments, the first layer of scrubbing material may include a nonwoven material. The scrubbing material of the first layer may include a high pulp content hydraulically entangled nonwoven composite fabric having from about 1 to about 25 percent, by weight, of a continuous filament nonwoven fibrous web and more than about 70 percent, by weight, of a fibrous material consisting of pulp fibers.

In various embodiments, the absorbent foam layer may include an open-cell, absorbent thermoplastic foam. In other embodiments, the absorbent foam layer may include an absorbent thermoset foam.

In various embodiments, at least one of the layers of the mop substrate may additionally include a functional substance that may be transferred to the surface upon which the mop substrate is to be used. Such a functional substrate may be a surfactant, a cleanser, a soap, a degreaser, a disinfectant, a sanitizer, a surface-protective wax, a glass cleaner, a surface polish, an insecticide, or other such substances that may be usefully incorporated into the mop substrate.

In some embodiments, the assembly may include a mop handle releaseably engaged with a socket mount on the mop head assembly. The mop handle may be a quick-release handle including a proximal end proximate to the mop head and a distal end distal to the mop head; a quick-release coupling assembly positioned on the proximate end of the handle, the quick-release coupling assembly configured to releaseably couple the handle to the head mount; and a button actuator positioned on the distal end of the handle, the button actuator operably connected to the quick-release coupling assembly. Additionally, in various embodiments, the handle may additionally include a coupler shroud that cooperatively couples with the head mount, the button actuator may be recessed within the end of the shaft, and the handle may include an ergonomic, freely-rotating knob.

The present invention is also directed to a multi-layer laminate substrate that may be used with a cleaning article. The substrate includes a strip having a pair of opposed strip side edges and a pair of opposed strip end edges. The strip has a first side including a first layer of scrubbing material and has a first face that may come into contact with a surface the upon which the cleaning article it to be used. The strip also has a second side including a second layer of scrubbing material and has a second face that may come into contact with a surface the upon which the cleaning article it to be used. Finally, the strip has an absorbent foam layer positioned between the first side and the second side such that the first face and the second face of the strip are outwardly facing. The first side, the absorbent foam layer and the second side are joined together by at least one or more bonds extending between the opposing strip side edges such that portions of the absorbent foam layer a exposed at the strip side edges.

In some embodiments the plurality of such strips are coupled with a head mount which may coupled to a handle. Additionally, the plurality of strips may include a mounting surface positioned centrally between the opposed strip end edges and the head mount may be coupled to the mounting surface of each of the plurality of strips. In some embodiments, the plurality of such strips may be arranged such that the mounting surfaces are superimposed. In other embodiments, the plurality of strips are positioned next to each other and aligned side by side along strip side edges in such a way that the mounting surfaces of the plurality of strips are aligned.

DETAILED DESCRIPTION

Figure 1:
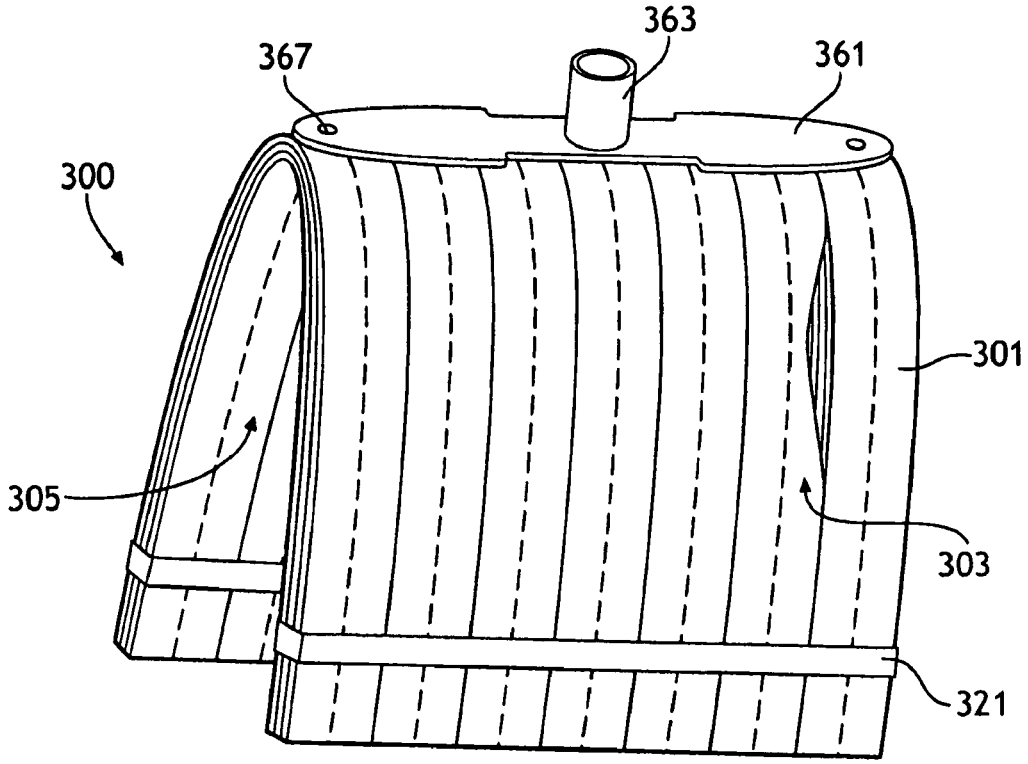
FIG. 1 is a perspective view of a wet mop head assembly of the present invention, showing a wet mop substrate in a sheet configuration.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to FIGS. 1 to 6 in general, the wet mop assembly 300 of the present invention uses a multi-layer laminate mop substrate 301 coupled with a head mount 361 which may be coupled to a handle when in use. The mop substrate 301 is designed to provide the mop with a high degree of absorbency and substance release, along with good abrasion resistance.

The mop substrate 301 is a multi-layer laminate that includes at least two layers of scrubbing material 313 and an absorbent foam layer 311 sandwiched between the scrubbing material layers 313. The absorbent foam layer 311 is made of an absorbent foam material that has excellent absorbency and liquid release characteristics. However, such absorbent foams have poor abrasion resistance. The scrubbing material layers 313 have good abrasion resistance and are positioned on either side of the absorbent foam layer 311 and provide some degree of protection to the absorbent foam layer 311 when the mop substrate 301 is in use.

Figure 2:
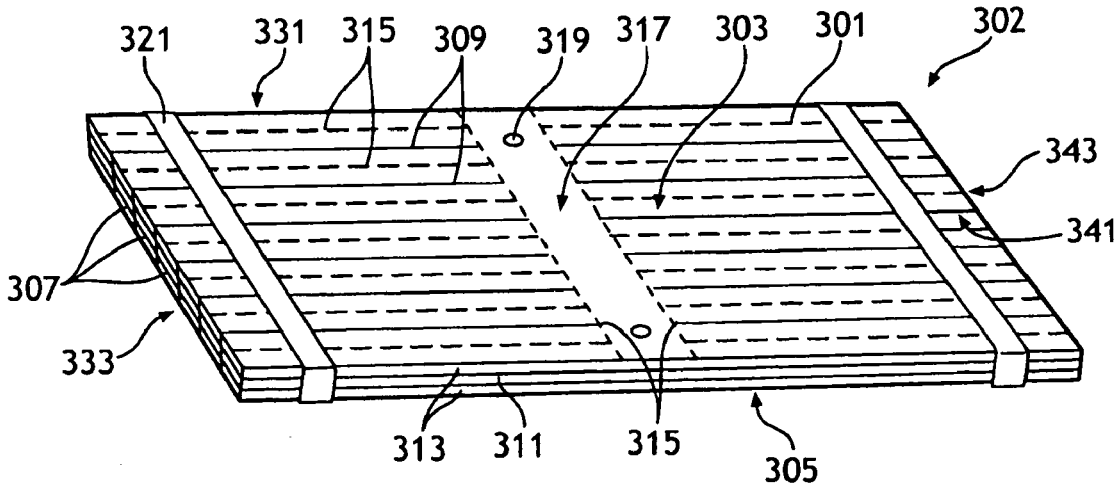
FIG. 2 is a perspective view of the sheet multilayer absorbent substrate of FIG. 1.

One example of a mop head assembly 300 using such a mop substrate 301 is illustrated in FIGS. 1 and 2. The mop substrate 301 may be a sheet 302 including a pair of opposed side edges 331 and a pair of opposed end edges 333. The sheet 302 is shown as generally rectangular in shape, but may be any shape, symmetrical or asymmetrical the meets the cleaning needs of the user. The sheet 302 has a first side 303 and an opposite second side 305. As illustrated in FIG. 2, the first side 303 of the sheet 302 corresponds to a face of one of the layers of scrubbing material 313; similarly, the second side 305 of the sheet 302 corresponds to a face of the other layer of scrubbing material 313.

A mounting section 317 is centrally located between the opposing end edges 333 and transversely spans the sheet 302 from one sheet edge 331 to the opposing sheet edge 331. The mounting section 317 is configured to couple the mop substrate 301 to the head mount 361. Mounting apertures 319 may be included in the mounting section to mate with mounting attachments 367 on the head mount 361. Such mounting attachments 367 may be any fastener capable of coupling the mop substrate 301 to the head mount 361 and holding the mop substrate 301 securely to the mop head 300 during use. Non-limiting examples of such mounting attachment 367 may include, screws, rivets, buttons, clips, adhesives, hook-and-loop fasteners, or other similar fasteners as are well known.

The sheet 302 is cut to produce a plurality of substrate strips 307 positioned on either side of the mounting section 317 and extending from the mounting section 317. The sheet 302 is cut along the cut lines 309 to produce the substrate strips 307. Thus, each substrate strip 307 will be made up of a pair of scrubbing material layers 313 with an absorbent foam layer 311 sandwiched between the scrubbing material layers 313. Further, each substrate strip 307 will have a pair of opposed strip side edges 341, created along the cut lines 309, and a strip free-end edge 343.

The substrate strips 307 may be cut along the cut lines 309 by any of such methods as are well known. By way of non-limiting example, the substrate strips 307 may be cut along the cut lines 307 by a die cut, shears, water-jet cutting, ultrasonics, rotary blade, or other similar method, as are known.

As shown in FIG. 1, when the head mount 361 is coupled to such a cut sheet 302, the substrate strips 307 will hang down from the mounting section 317, much like how the cotton strings hang down on a traditional cotton string mop. In use when the mop head 300 is picked up (see FIG. 1) the first side 303 of the sheet 302 will be presented as the outermost surface of the mop head 300 and the second side 305 of the sheet 302 will face itself on the interior of the mop head 300. During use the mop head 300 may be used in the folded configuration shown in FIG. 1 or may also be used in a flat configuration such as shown in FIG. 2.

The mounting section 317 is shown in FIGS. 1 and 2 as centrally located on the substrate sheet 302. In such a position, between the opposing sheet end edges 333, the substrate strips 307 extending for such a mounting section 317 will generally be equal in length and the mop head 300 will be substantially symmetrical about a center line extending between the opposed sheet side edges 331 half-way between the opposed sheet end edges 333. This is one example of a possible sheet substrate 302; other configurations may be possible. By way of non-limiting examples of alternate configurations, the sheet 302 may be cut such that substrate strips 307 have different lengths, the mounting section 317 may be positioned closer to one sheet end edge 333 that the other to produce an asymmetric sheet 302, or some other particular configuration that meets the specific cleaning needs of the user.

Additionally, bands 321 may be coupled to the sheet 302 proximate to the sheet end edges 333. Such bands 321 (often referred to as "janitor wish bands") are well known and readily available to help prevent the individual substrate strips 307 from becoming tangled during use of the mop head 300. Such a band 321 may be coupled to the sheet 302 by stitching, ultrasonic bonds, adhesives, or other such fastening means as are well known.

The sheet 302 may be any size as desired by the user and that meets the particular cleaning needs. Typically, the sheet 302 will have a width (the distance between the sheet side edges 331) between about 6 inches (152 mm) and about 24 inches (610 mm), and will have a length (the distance between the sheet end edges 333) between about 12 inches (305 mm) and about 48 inches (1.22 m); although other sizes are possible.

The substrate strips 307 may be cut within the sheet 302 to have a width (the distance between the strip side edges 341) of between about 0.5 inches (12.7 mm) and about 4 inches (102 mm); although other strip widths are possible. The substrate strips 307 are shown in FIGS. 1 and 2 as generally uniform in their width. However, the substrate strips 307 may have different individual widths across the width of the sheet 302.

The length of the substrate strips 307 is dependent on the length of the sheet 302, the size of the mounting section 317, and the length of the cut lines 309. For example, if the sheet 302 is 36 inches (914 mm) in length and the mounting section 317 utilizes 2 inches (50.8 mm) of the length of the sheet 302 to accommodate the head mount 361, the resultant substrate strips 307 extending on either side of the mounting section 317 would be about 17 inches (432 mm) in length. However, other substrate strip 307 dimensions are possible.

An example of preferred mop substrate 301 dimensions is a sheet 302 measuring 36 inches (914 mm) in length and 12 inches (305 mm) in width. The mounting section 317 of the example substrate 301, spans the width of the sheet 302 and has a length of 2 inches (50.8 mm) and is positioned 17 inches (432 mm) from either of the opposed sheet end edges 333. Cut lines 309 are made every 1-inch (25.4 mm) across the width of the sheet 302; the cut lines 309 extending 17 inches (432 mm) from the sheet end edges 333 to the mounting section 371. Thus, in use, the mop substrate 301 will include twenty-four individual substrate strips 307 (twelve on either side of the mounting section 317), each 17 inches (432 mm) long and 1-inch wide (25.4 mm), and hanging down from the mounting section 317.

Additionally, the mop head 300 illustrated in FIG. 1 shows a single mop substrate 301 coupled to the head mount 361. However, one or more additional mop sheet substrates 302 may be layered and attached to the head mount 361 such that the second side of the mop sheet substrate shown in FIG. 1 would be in contact with the first side of the subsequent mob sheet substrate. Alternatively, one or more additional mop sheet substrates 302 may each be folded and attached to the same head mount 361 in such manner as shown in FIG. 1, such that first side of each sheet substrate would be next to the first side of the subsequent sheet substrate.

Figure 5:
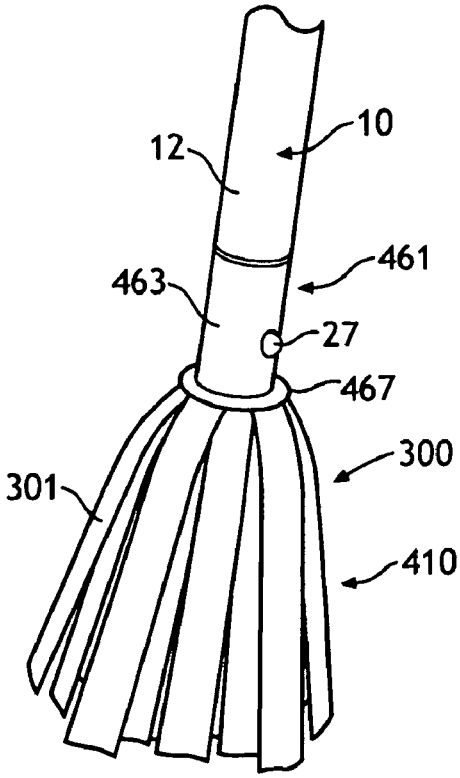
FIG. 5 is a partial perspective view of a wet mop head of the present invention coupled with a quick-release handle.
Figure 6:
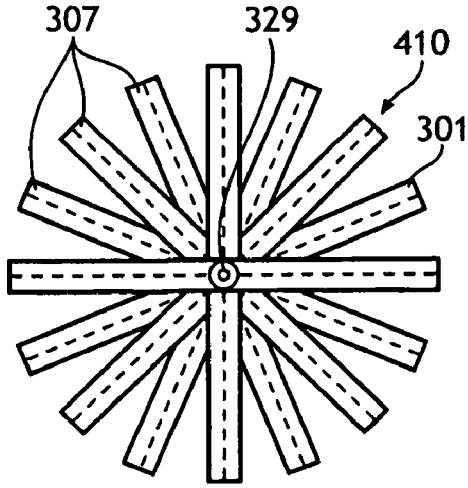
FIG. 6 is a top view of the substrate strip configuration of a wet mop head of FIG. 5.

Another example of a mop head assembly 300 that may be possible using the mop substrate 301 is illustrated in FIGS. 5 and 6. The mop substrate 301 may be an substrate strip arrangement 410 including a plurality of substrate strips 307 that are configured in a superimposed orientation relative to one another.

As illustrated in FIG. 6, individual substrate strips 307 each having an absorbent foam layer 311 sandwiched between two scrubbing material layers 313 may be configured into a strip arrangement 410 and coupled to a head mount 461. Each substrate strip 307 having a pair of opposed strip side edges 341 and a pair of opposed strip end edges 343. A mount aperture 329 may be present on each substrate strip 307 to couple the substrate strip 307 to the head mount 461.

Each of the substrate strips 307 may be individually formed or they may be cut from a sheet 302 such as shown in FIG. 2. The individual substrate strips 307 are oriented in the superimposed configuration, with each substrate strip 307 laying on top of the subsequent substrate strip 307, as shown in FIG. 6. In the superimposed configuration illustrated in FIG. 6, the mount aperture 329 of each of the substrate strips 307 is positioned centrally between the strip side edges 341 and the strip end edges 343. The mount apertures 329 of each the substrate strips 307 are aligned such that a single fastener may be used to couple all of the substrate strips 307 to the head mount 461.

The multiple layers of the composite substrate 301 of the present invention are joined together by at least one bond 315. Such bond(s) 315 may be any method or means appropriate to join together the scrubbing material layers 313 and the absorbent foam layer 311 disposed between the scrubbing material layers 313. Non-limiting examples of such bond(s) 315 may include adhesives, stitching, ultrasonic bonds, thermal bonds, impulse heat, fasteners, any other of the numerous means or method for bonding materials as are well known, or combinations thereof. The bond(s) 315 may be continuous lines of bonding or may be discontinuous bonds.

Figure 3:
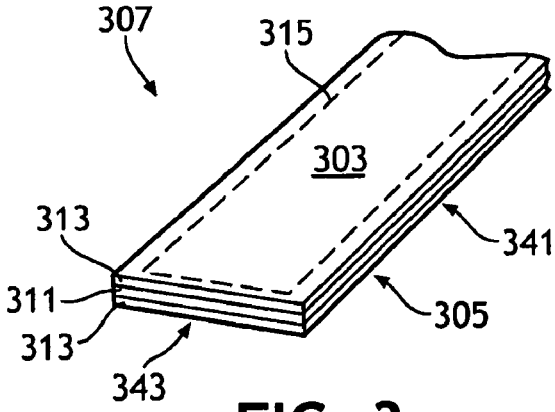
FIG. 3 is a partial perspective view of a free end of a substrate strip of the wet mop substrate of FIG. 1, showing a peripheral bond arrangement joining the layers of the substrate strip.

The placement of such bond(s) 315 may influence the performance and integrity of the substrate 301. For example, as shown in FIG. 3, two lines of bonds 315 are positioned to define the mounting section 317 of the sheet 302. Such lines of bonds 315 would assist in maintaining the integrity of the substrate 301 in mounting section 317 of the sheet 302. The mounting section 317 bonds also define the attached end of the substrate strips 307 on such sheets 302.

Bond(s) 315 may also be present on the individual substrate strips 307 of substrates 301. The placement of such bonds 315 influences the performance of the substrate strips 307 and thus the overall performance of the mop substrate 301. One possible bond configuration is shown in FIG. 3. The bonds 315 are intermittently placed along the periphery of the substrate strip 307; the bonds 315 are along the strip side edges 341 and strip end edge 343. With such a bond configuration, the scrubbing material layers 313 substantially covers the absorbent foam layer 311, leaving only the edge surfaces of the absorbent foam layer 311 exposed. Such an absorbent foam layer 311 will only be able to absorb liquids, or release a liquid, through the edges where the substrate strip 307 is unbonded. If the absorbent foam is hydraulically needled or otherwise post-treated to provide open-cells to the face of the foam layer 311 (as discussed below), the foam layer 311 may additionally be able to absorb liquids, or release liquids, passing through the scrubbing material layers 313 to the absorbent foam layer 311.

The peripheral bonding configuration illustrated in FIG. 3 may limit the amount or the rate that a liquid is absorbed into, or released from, the absorbent foam layer 311. However, such a configuration also provides the most protection for the absorbent foam layer 311 during use. As discussed, an absorbent foam has low abrasion resistance and can degrade and break apart under continued scrubbing. By encasing the absorbent foam layer 311 in the scrubbing layers 313, the absorbent foam is protected from degradation from scrubbing.

Figure 4:
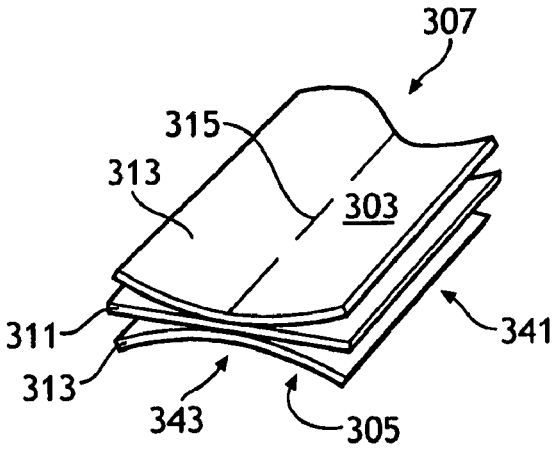
FIG. 4 is a partial perspective view of a free end of a substrate strip of the wet mop substrate of FIG. 1, showing a centralized bond arrangement joining the layers of the substrate strip.

An alternate bond pattern for the substrate strips 307 is illustrated in FIG. 4. As shown, the bonds 315 are positioned centrally between the substrate strip side edges 341 at the midway point between the side edges 341. Compared to the peripheral bond configuration of FIG. 3, the central bond configuration of FIG. 4 provides less protection to the absorbent foam layer 311. While the scrubbing substrate layers 313 generally will protectively cover the absorbent foam layer 311 during use, the scrubbing layer 313 may at times fold over and expose the absorbent foam layer 311 to scrubbing. Thus, while the scrubbing layer 313 of such a central bond configuration of FIG. 4 will provide the absorbent foam layer 311 with more protection that if the absorbent foam layer 311 was used on its own, it will provide less protection than the peripheral bond configuration of FIG. 3.

However, this lesser degree of protection is offset by the benefits of better absorbency and liquid release that the central bond configuration of FIG. 4 presents compared to the peripheral bond configuration of FIG. 3. As can be seen in FIG. 4, with the bonds 315 positioned down the center of the substrate strip 307, a greater portion of the absorbent foam layer 311 is exposed at the strip side edges 341. Additionally, where the absorbent foam has been post-treated to increase the absorbency through the face of the layer 311, the central bond configuration also exposes more of the face of the absorbent foam layer 311 to liquid, where the liquid does not have to first pass through the scrubbing material layer 313. As such, the bond configuration of FIG. 4 will have a greater amount and rate of absorbency compared to the bond configuration illustrated in FIG. 3.

One skilled in the art could see how the orientation and amount of bonds 315 could be designed for a particular combination of scrubbing materials 313 and absorbent foam 311 to control the level and rate of absorbency, and/or fluid release, of such a laminate substrate 301. Additionally, the substrate strips 307 of a mop substrate 301 may include a combination of substrate strips 307 with different bonding patterns to balance the trade-off of protecting the absorbent foam and the absorbency of the foam within a particular mop head 300. For example, the mop head 300 shown in FIG. 5 includes a substrate strip 307 having a central bond configurations, as in FIG. 4, and another substrate strip 307 having a peripheral bond configuration, as in FIG. 3.

Additional functionality may be added to the head mount 361 by including a disposal feature. One such disposal feature may be a sheath (not shown) attached to the head mount 361 that may be pulled down over a used mop substrate 301 to completely contain the mop substrate 301 for easy and cleanly disposal. Such a disposal sheath would be waterproof and compatible with any substances that the mop may be used with. Ties, cinches, or an adhesive closure may be included with the disposal shroud to secure the sheath closed during disposal.

All of the examples discussed have been related to the multi-layered substrate 301 as a part of a mop head 300. However, a substrate having an absorbent foam layer 311 sandwiched between two layers of scrubbing material 313 may be used with other cleaning articles. For example, the substrate 301 may be coupled to a wand, a knob or a simple grip to be used to dust surfaces, to apply furniture polish, clean a bathtub, clean windows, or the like. Similarly, the substrate 301 may be in the form of a wiper, a mit, or other such simple form to be used in a similar fashion.

The mop head 300 of the present invention may be included as part of a mop system that also includes a handle configured to be coupled to the head mount 361. Such a handle may be a traditional mop stick, as are well known, having a conventional threaded tip that screws into the head mount 361 or some other similar common coupling mechanism.

However, it is preferred that the handle of the mop system be a quick-release handle 10 that allows the user to disengage the handle 10 from the mop head 300 without having to bend over, reposition the mop, or otherwise come in close contact with the potentially dirty mop head 300.

Referring to FIGS. 8 to 12 in general, the quick-release handle 10 that may be used with the mop head 300 invention includes an elongated shaft 12 having two opposite ends; a proximal end 16 and a distal end 18. The proximal end 16 is proximate to the mop head 300 to which the handle 10 is to be attached. The distal end 18 is distal to the proximal end 16 and proximate to the user. The proximal end 16 includes the quick-release coupling assembly 20 that will cooperate with and couple the handle 10 to a mop head 300. The proximal end 16 is also considered as the attachment end of the handle 10 and the terms "proximal end" and "attachment end may be used interchangeably.

Generally, the distal end 18 will have a grip 41 by which the user may grasp the handle 10. The distal end 18 is also considered the grip end of the handle 10 and the terms "distal end" and "grip end" may be used interchangeably. Additionally, the distal end 18 accommodates the button actuator 45 which the user depresses to release the coupling assembly 20 from any mop head 300 that may be coupled with the proximal end 16 of the handle 10. Thus, the user can release a mop head 300 from the handle 10 by manipulating the distal end 18 rather than repositioning the handle, bending over, or going anywhere near the potentially dirty proximal end 16 of the tool.

Figure 8:
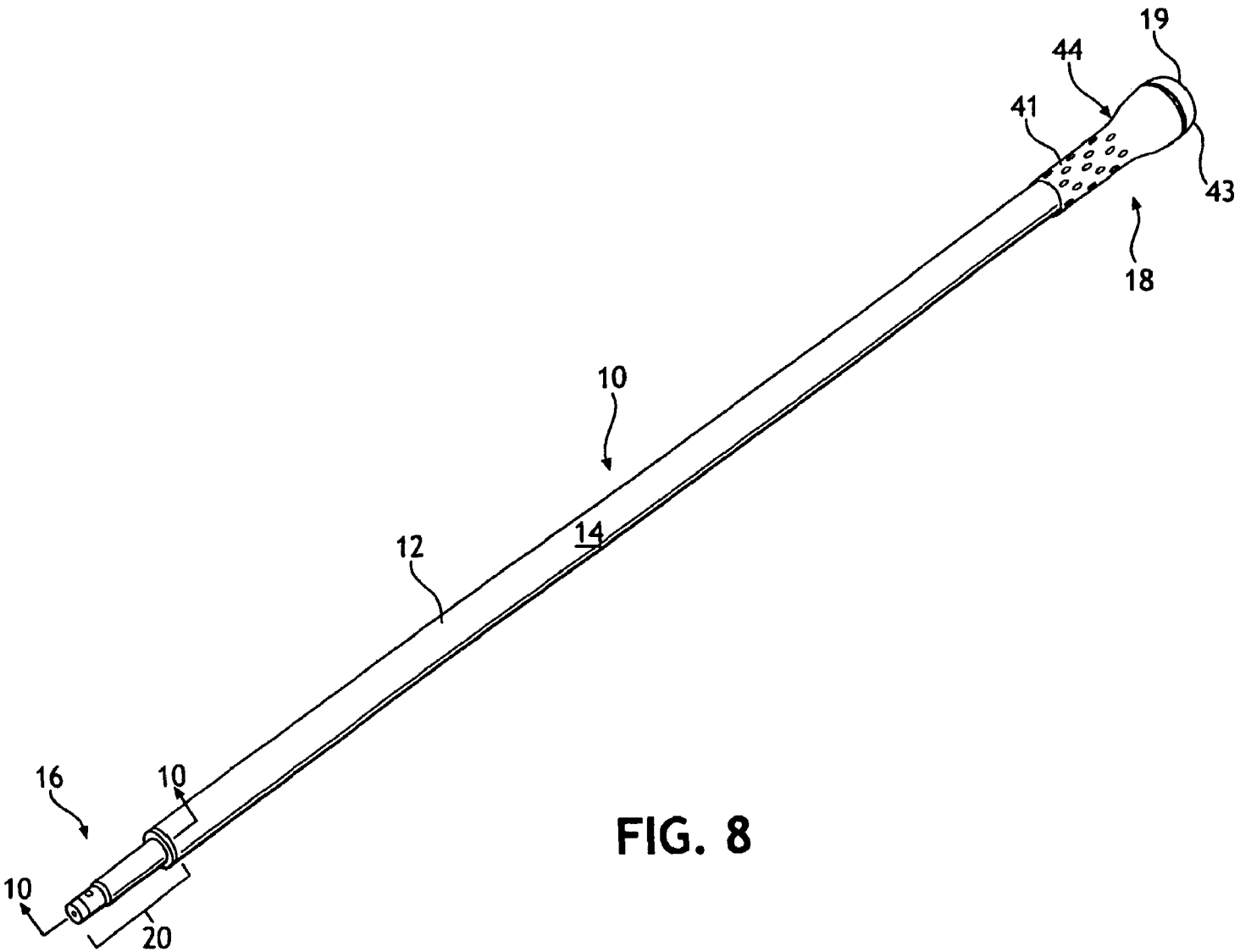
FIG. 8 is a perspective view of the quick-release handle.

The elongated shaft 12 is shown in FIG. 8 as generally cylindrical in shape, having a circular cross-section, as is common for most commonly available long tool handles. As such, the elongated shaft 12 has a single peripheral surface 14. However, other cross-sectional shapes are contemplated and are considered within the scope of the present invention. By way of non-limiting examples, the cross-sectional shape of the elongated shaft 12 may be elliptical, polygonal, or any other symmetrical or asymmetrical shape. Any such alternative cross-sectional shape may provide the elongated shaft 12 with additional peripheral surfaces 14.

Generally, it is desired that the elongated shaft 12 have a length of about 36 inches (0.9 m) to about 72 inches (1.8 m). For a quick-release handle 10 for use with the mop head 300, the elongated shaft will preferably be about 5 feet (1.5 m) in length, similar to the length of commonly available tool handles. The elongated shaft 12 should have an outside diameter suitable for the intended tool mop head 300 and that is comfortable for use by range of user hand sizes. Typically, the outside diameter will be in the range of about 0.5 inches (12.7 mm) to about 1.5 inches (38.1 mm). Preferably, the outside diameter of the shaft 12 will be similar to that of commonly available handles, 0.75 inches (19.1 mm). Also, the shaft 12 illustrated in FIG. 1 is generally uniform in its diameter from the proximal end 16 to the distal end 18. However, the shaft 12 may alternatively have a non-uniform diameter along its length and may have sections of uniform and non-uniform diameter along its length.

The elongated shaft 12 is hollow to accommodate the push rod 31 and the other associated elements of the button actuator 45 and quick-release coupling assembly 20. The hollowed nature of the shaft 12 also decreases the weight of the handle 10 and the amount of material used in making the handle 10. The thickness of the hollow elongated shaft 12 is a function of the materials used to make the shaft 12, the inside diameter required to accommodate the elements to be accommodated within the shaft 12, and the strength and weight desired. One skilled in the art would see how such variables could be balanced to produce the desired shaft 12.

The elongated shaft 12 may be made from any material that meets the needs of the various mop heads 300 with which such a handle 10 is expected to be used. For example, a stronger shaft 12 may be desired for commercial applications while a lighter shaft may be desired for home applications. Other considerations may include, but are not limited to, weight, durability, compatibility with chemicals and substances the handle may come in contact, appearance, ease of cleaning, colors available, disposability, and the like. Typically, the shaft 12 may be made of a metal, plastic, or wood. More particularly, the shaft 12 may be made of aluminum, stainless steel, ABS-plastic, or the like. Again, one skilled in the art would see how such variables could be balanced to produce the desired shaft 12.

Additionally, designs in which the shaft 12 is telescoping, collapsible, and/or foldable are also considered to be within the scope of the present invention.

As discussed above, the quick-release coupling assembly 20 is positioned on the proximal end 16 of the handle 10 and is configured to be coupled with a mop head 300. The coupling assembly 20 may utilize any releasable coupling mechanism, as are well known, to releaseably couple with a mop head 300. By way of non-limiting examples, such a releasable coupling mechanism may utilize a detent ball assembly (as illustrated in FIGS. 9, 10A and 10B), a collet, a chuck, a clamping spring, a bayonet mount, a barbed fastener, a ribbed shank clip fastener, or other such mechanisms or any combination thereof.

The mechanism of the coupling assembly 20 is actuated by the user pressing and releasing the button actuator 45 on the distal end 18 of the shaft 12. The button actuator 45 is operably connected with the coupling assembly 20 by the push rod 31 which extends along the length of the shaft 12, from the button actuator 45 to the coupling assembly 20. As can be seen in the example illustrated in FIGS. 9, 10A, 10B, 11A, 11B and 12, the button actuator 45 is the terminus of the push rod 31 on the distal end 18 of the handle 10. At the proximal end of the push rod 31, a stop collar 33 is fitted around and attached to push rod 31 by a pin 34. A spring 35 around the push rod 31 and compressed between the stop collar 33 and the end wall of the stepped tip 21 of the coupling assembly 20 keeps the push rod 31 biased toward the distal end 18.

Figure 9:
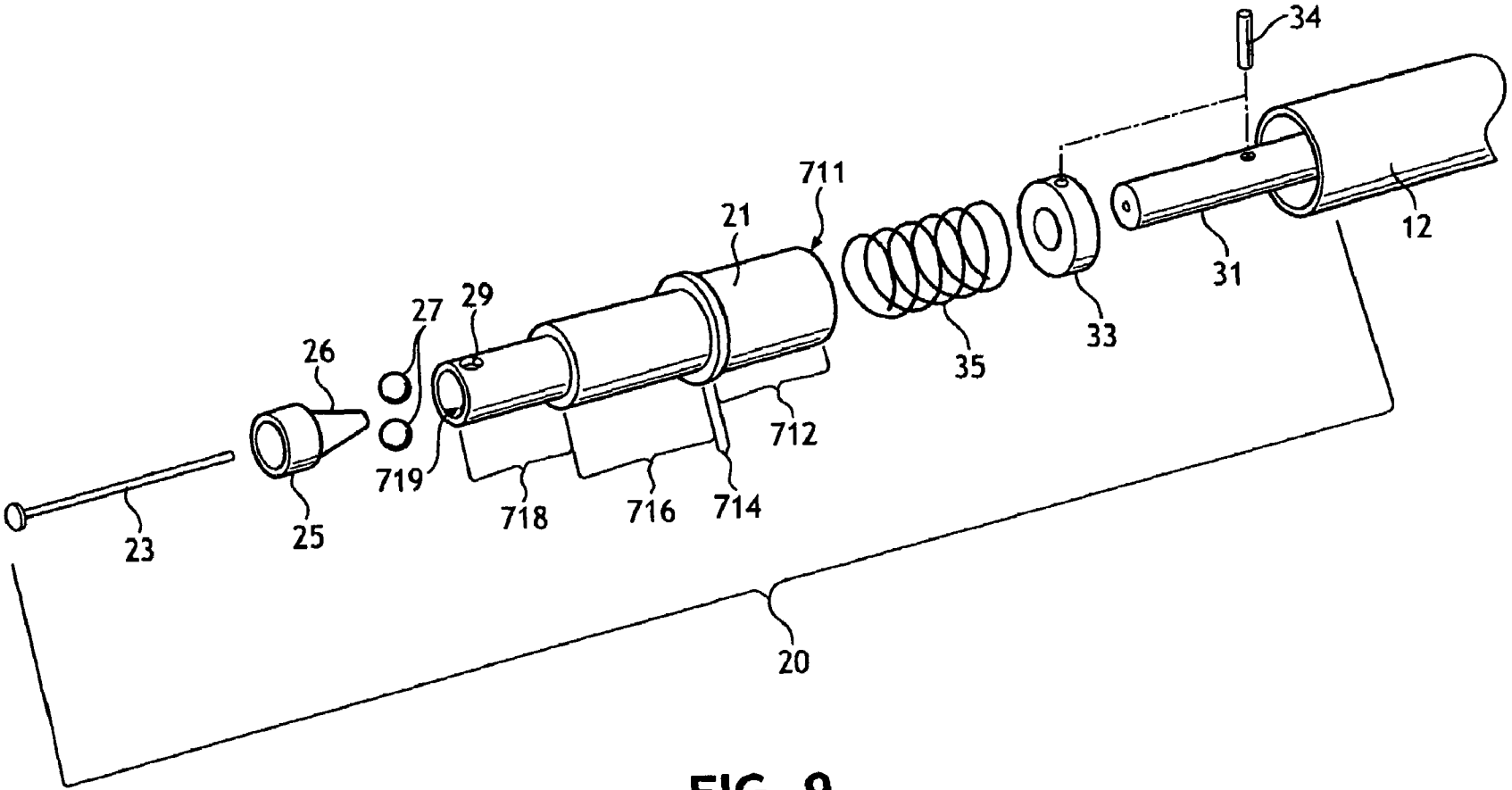
FIG. 9 is a partial perspective exploded view of a quick-release coupling assembly of the handle of FIG. 8.
Figure 10A:
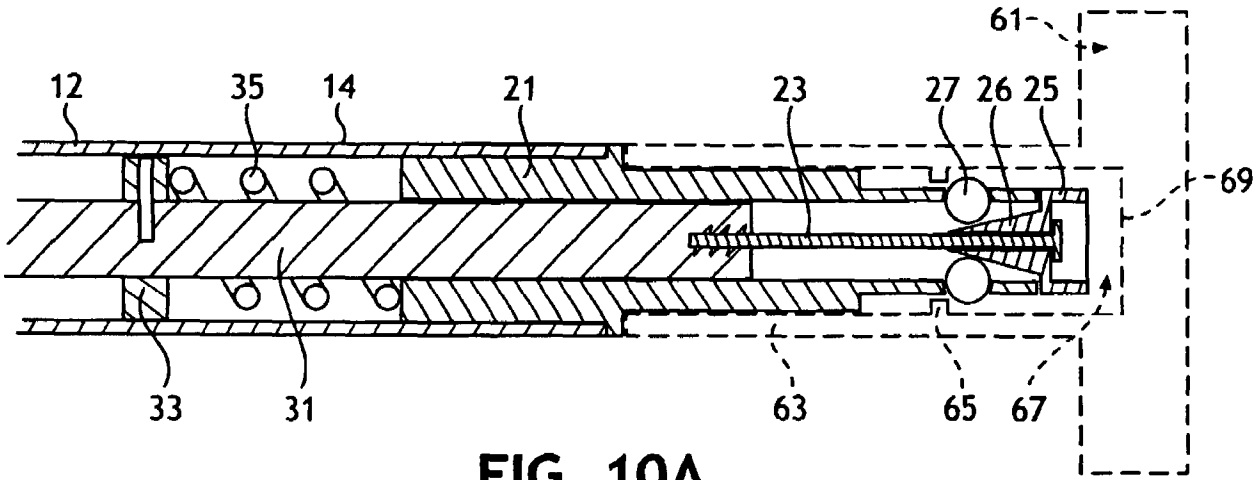
FIG. 10A is a cross-sectional view of a quick-release coupling assembly of the handle of FIG. 8 taken along line 10-10, shown in an engaged configuration with a generic socket mount (illustrated by phantom lines)
Figure 10B:
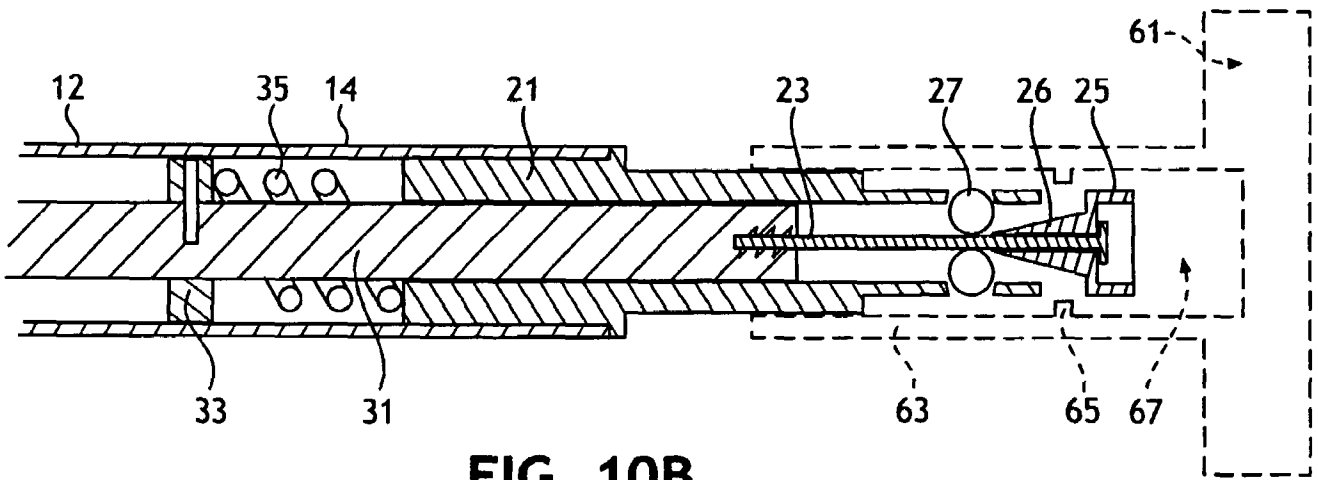
FIG. 10B is a cross-sectional view of the quick-release coupling assembly of the handle of FIG. 8 taken along line 10-10, shown in a release configuration in relation to the generic socket mount (illustrated by phantom lines)

As shown in FIGS. 9, 10A, and 10B, the coupling assembly 20 at the proximal end 16 of the shaft 16 includes a stepped tip 21 having a first end 711 inserted into the proximal end 16 of the shaft 12 and a second end 719 that extends from the end of the shaft 12 and into the socket mount 63 of a head mount 61 of a working head to which the handle 10 is to be coupled. The stepped tip 21 has an internal longitudinal channel 22 that extends the length of the stepped tip 21, from the first end 711 to the second end 719. The first section 712 of the stepped tip 21 near the first end 711 has a diameter slightly smaller than the inside diameter of the shaft 12 such that the stepped tip 21 may be snuggly fit into the proximal end 16 of the shaft 12. A lip section 714 of the stepped tip 21 seats the stepped tip 21 in the proximal end 16 of the shaft 12 and prevents the stepped tip 21 from being pushed further into the shaft 12.

As illustrated in FIGS. 10A and 10B, once the stepped tip 21 is installed in the shaft 12, the push rod 31 extends into the longitudinal channel 22 of the stepped tip 21. A stop rod 23 extends from the proximal end of the push rod 31 and is attached to the end of the push rod 31. The stop rod 23 extends out of the longitudinal channel 22 at the second end 719 of the stepped tip 21 and is capped by a head portion 25. The head portion 25 has a conical portion 26 that extends around the stop rod 23 inside the longitudinal channel 22. When the stop rod 23 is attached to both the push rod 31 and the head portion 25, the spring 31 that biases the push rod 31 toward the distal end 18 (as discussed above) also pulls the head portion 25 against the second end 719 of the stepped tip 21.

The third section 718 of the stepped tip 21 additionally includes ports 29 that extend from the longitudinal channel 22 to the outer surface of the stepped tip 21. A single detent ball 27 is retained by each port 29 and against the stop rod 23 or the conical portion 26.

When the handle 10 and coupling assembly 20 are in the engaged configuration, such as shown in FIG. 10A, the spring 35 between the stop collar 33 and the first end 711 of the stepped tip 21 biases the push rod 31 toward the distal end 18 of the shaft 12. The stop rod 23 attached to both the head portion 25 and the push rod 31 is subsequently pulled into contact with the second end 719 of the stepped tip 21. The head portion 25 is only pulled to the second end 719 and thus the spring 35 cannot push the push rod 31 further toward the distal end 18 or pull the stop rod further into the stepped tip 21. In such an engaged configuration, the coupling assembly 20 and push rod 31 are held in a neutral state by the spring 35.

As shown in FIG. 10A, when the coupling assembly 20 is in the engaged state, the head portion 25 is pulled to the second end 719 of the stepped tip 21 such that the conical portion 26 of the head 25 is pulled into the longitudinal channel 22. The conical portion 26 engages the detent balls 27 and pushes them into the ports 29 such that the detent balls partially extend outside of the exterior wall of the third section 718 of the stepped tip 21.

FIG. 10B illustrates the release configuration of the handle 10 and coupling assembly 20. When the user depresses the button actuator 45 at the distal end 18, the push rod 31 and the stop collar 33 is pushed toward the proximal end 16 of the shaft 12, compressing the spring 35 between the stop collar 33 and the first end 711 of the stepped tip 21. The stop rod 23, including the head 25, is consequently pushed away from the second end 719 of the stepped tip 21. As the conical portion 26 of the head 25 is pushed toward the second end 719, the detent balls 27 are allowed to fall back into the longitudinal channel 22 and against the stop rod 23. When the user releases the button actuator 45, the spring 35 returns the handle 10 to the engaged, or neutral, configuration as illustrated in FIG. 10A.

Various working heads could be used with this type of handle 10 and coupling assembly 20. To work with the coupling assembly 20, the particular working head should include a head mount 61 that includes a socket mount 63 into which the coupling assembly 20 may be inserted. A retention stop 65 within the socket mount 63 cooperatively engages with the coupling assembly 20 to securely couple the working head and the quick-release handle 10. Such a retention stop 65 may be anything within the socket mount 63 that cooperatively engages the detent balls 27 of the coupling assembly 20. By way of non-limiting examples, the retention stop 65 may be a ring fixed within the socket mount 63 (as shown in FIGS. 10A and 10B), recesses within the wall of the socket mount 63, holes in the socket mount 63 (as shown in FIG. 5), or another configuration which can engage the detent balls 27.

In operation, when the coupling assembly 20 is inserted into the socket mount 63, the stepped tip 21 would proceed from the mouth of the socket recess 67 toward the recess terminus 67. When the coupling assembly 20 is in the engaged (neutral) configuration, the detent ball 27 are pushed out of the ports 29 by the conical portion 26 of the head 25, as discussed above. The inside diameter of the ring used as the retention stop 65 shown in FIGS. 10A and 10B is designed to be slightly larger than the outer diameter of the third portion 718 of the stepped tip 21. Thus, as the stepped tip 21 is inserted into the socket mount 63, the third portion 718 snugly passes into the retention stop 65, but the protruding detent balls 27 will come into contact with the retention stop 65. As the user continues to apply insertion pressure to the stepped tip 21, the detent balls 27 are forced into the ports 29 and push against the conical portion 26 and consequently push the head 25 from the second end 719. Once the stepped tip 21 is pushed farther into the socket mount 63, the detent balls 27 clear the retention stop 65 and are again forced out of the ports 29 by the conical portion 26. The detent balls 27 engage the retention stop 65 as illustrated in the engaged configuration shown in FIG. 10A.

The socket mount 63 includes a socket recess 67 on the recess terminus side of the retention stop 65. Such a recess 67 allows enough room for the head 25 to extend from stepped tip 21 as necessary for the detent balls 27 to drop inside the stepped tip 21 during insertion of the coupling assembly 20 or release of the working head, as discussed above.

The use of a coupling assembly 20 with the detent ball 27 mechanism described and illustrated in FIGS. 9, 10A and 10B, is only one possible coupling assembly 20 that may be used in the handle 10 of the present invention. As discussed above, other coupling mechanisms are contemplated for the coupling assembly 20 to couple the handle 10 with a mop head 300 and operably connect to the button actuator 45 such that the mop head 300 is released from the handle 10 when the button actuator 45 is manipulated.

For increased universality, the socket mount 63 may additionally be threaded from the mouth of the socket mount 63 to the retention stop 65. Such a socket mount 63 could then also accept a standard handle with a thread tip, if the user so desired.

The second section 716 of the stepped tip 21 is designed to have an outside diameter slightly smaller than the inside diameter of the socket mount 63. This ensures that the coupling assembly 20 snuggly fits within the socket mount 63 such that the mop head 300 is securely and solidly held at the end of the handle 10. If the socket mount 63 is threaded, the second section 716 would need to have an outside diameter slightly smaller that the threads.

Although not shown, a second spring could be included inside of the socket mount 63, attached to the recess terminus 69. Such a spring would be compressed upon insertion of the coupling assembly 20 into the socket mount 63. When the button actuator 45 was subsequently pressed to release the mop head 300 from the handle 10, such a spring would then bias the socket mount 63 off of the coupling assembly 20.

Figure 7A:
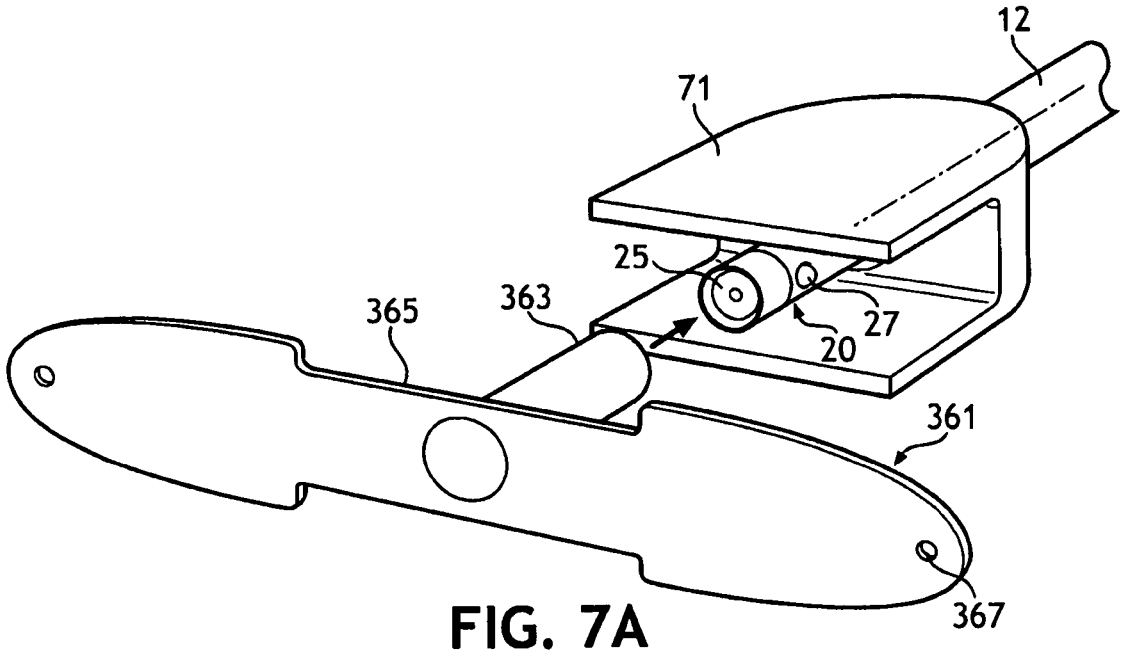
FIG. 7A is a partial perspective view of the proximal end of a quick-release handle of the present invention, the proximal end including a head shroud and positioned to engage a head mount of the mop assembly of FIG. 5.
Figure 7B:
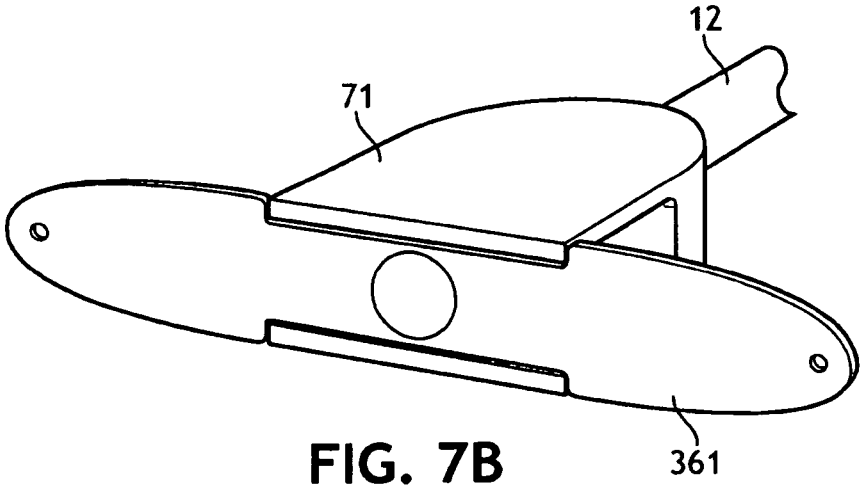
FIG. 7B is a partial perspective view of the proximal end of the quick-release handle of FIG. 7A showing the coupler shroud coupled to the head mount.

Additional stability may be added to the connection of the head mount of the mop head 300 and the coupling assembly 20 by the inclusion of a coupler shroud 71 at the proximal end 16 of the shaft 12. As shown in FIGS. 7A and 7B, the coupler shroud 71 has portions that both protect the exposed coupling assembly 20 from damage and cooperate with the designs of the head mounts to securely couple the mop head 300 and handle 10.

FIGS. 7A and 7B show an example of the coupler shroud 71 protecting the coupling assembly 20 on the proximal end 16 of a shaft 12. A wet mop head mount 361 is also shown, without the mop substrate attached to the head mount 361. Such a head mount 361 has shoulder portions 365 that cooperatively engage with the head shroud 71. As shown in FIG. 7B, once the head mount 361 is engaged, the head mount 361, consequently the wet mop head including the head mount 361 is not able to rotate about the shaft axis.

To aid the user in grasping the handle 10, the distal end 18 may be equipped with a grip 41 and a knob 43. The grip 41 has a slightly larger diameter than the shaft 12 and is preferably made of material, or is otherwise designed, to facilitate grasping of the shaft 12. Additionally, such a grip 41 should be designed to have the necessary durability required for the typical use of such handle 10. For example, the grip 41 may be made of rubber, plastic, metal, or the like. Such materials may be given a texture through processing or through design by the addition of ridges, patterns, or divots to the surface of the grip 41 (as shown in FIGS. 11A and 11B).

The grip 41, as shown in FIGS. 8, 11A, 11B and 12, may additionally have a knob 43 that also provides the user with more comfort than a traditional stick used with common brooms or mops. Generally, such traditional sticks merely have the end rounded off and cause fatigue to the user's hand and often result in blisters and calluses in the palm of the hand after extended use. The small diameter of the end of such traditional sticks causes discomfort and is often difficult for the user to fully grasp.

Figure 11A:
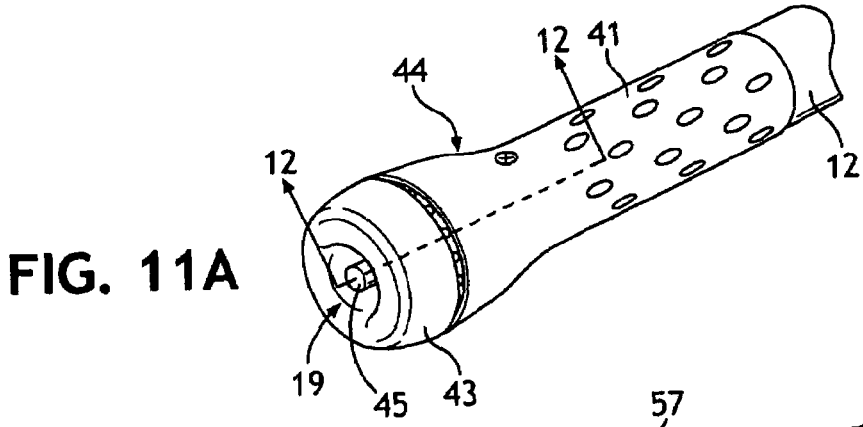
FIG. 11A is a partial perspective view of the distal end of the quick-release handle of FIG. 8 showing a grip, a freely-rotating knob, and a button actuator.
Figure 11B:
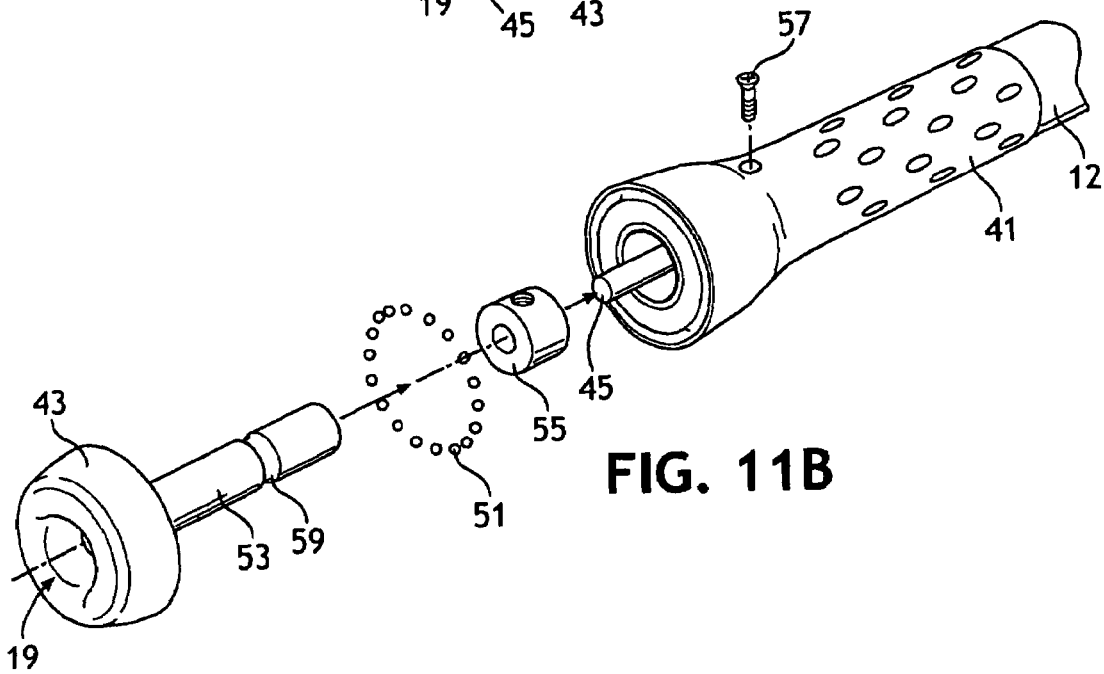
FIG. 11B is a partial perspective exploded view of the distal end of the quick-release handle of FIG. 11A.
Figure 12:
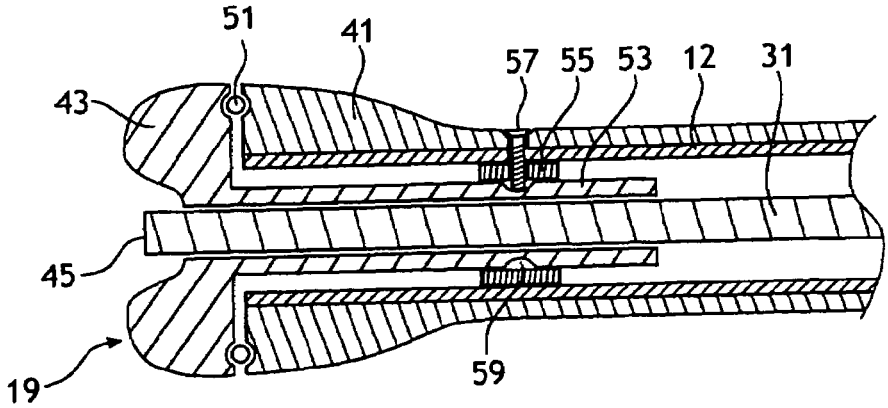
FIG. 12 is a cross-sectional view of the distal end of the quick-release handle of FIG. 11A taken along the line 12-12.

A knob 43 such as shown in FIGS. 11A, 11B and 12, provides the user with a much larger diameter end to the handle 10 compared to traditional sticks. The larger diameter of the knob 43, relative to traditional sticks makes the knob 43 much easier to grasp. By increasing the surface area of the distal end surface 19 of the knob 43, the forces experienced by the user's hand are spread out over a greater surface area than can be achieved by a rounded end of a traditional stick. Such a better distribution of forces result in a reduction in the amount of fatigue the user experience in their hand.

The knob 43 may be formed as a unitary part of the terminus of the grip 41 or it may be an additional part added to the distal end 18 of the shaft 12. The knob 43 shown in FIGS. 11A, 11B and 12 is only intended to be an exemplary shape for such a knob 43; the knob 43 may be any size and shape, symmetrical or asymmetrical, that allows the user to comfortably grasp and utilize the handle 10.

As can be seen in FIGS. 8 and 11A, the shape of the knob 43 is extended to the grip 41 of the distal end 18 of the handle 10. This functional grab area 44 of the knob 43 allows a user to maintain a grip of the knob 43, when the user pushes the handle 10 away from their body. This is particularly useful in mopping when a user will regularly "cast out" a mop and then bring the handle 10 and mop back to themselves.

Additionally, the button actuator 45 is also present at the distal end 18 of the handle 10. As shown in FIGS. 11A and 12, the button actuator 45 is incorporated into the knob 43 and is recessed within the distal end surface 19. As such, the user may grasp the knob 43 during use without unintentionally depressing the button actuator 45 and accidentally releasing the mop head 300. The button actuator 45 shown in FIGS. 11A, 11B, and 12 is merely the terminus of the push rod 31. However, the button actuator 45 may be a separate piece attached or otherwise operably connected to the push rod 31

The knob 43, as shown in FIGS. 11A, 11B and 12, may additionally have the added ability to freely rotate 360-degrees on the terminus of the distal end 18 of the shaft 12. Such a freely-rotating knob 43 would reduce the rubbing and twisting that the user's hand experiences when using traditional sticks. By allowing the knob 43 to freely rotate, the user may maintain a grasp on the knob 43 during regular use of the tool and avoid the fatigue and blisters that often accompanied use of a traditional push broom, mop, or floor duster.

The rotation of the knob 43 may be accomplished with by any type of mechanical bearings, as are well known, that allow the desired 360-degrees of free rotation. By way of non-limiting examples, the rotation may be accomplished with sliding bearings or bushings, rolling-element bearings (such as ball bearings, roller bearings, taper roller bearings), fluid bearings, magnetic bearings, or the like. In the example shown in FIGS. 11A, 11B, and 12, the rotation of the knob 43 is accomplished with a track of ball bearings 51 that are held in place by cooperative recesses in both the end of the grip 41 and in the knob 43. The ball bearings 51 allow the knob 43 to freely-rotate a full 360-degrees about the axis of the shaft 12, on the end of the grip 41.

The assembly of the freely-rotating knob 43 is illustrated in FIGS. 11A, 11B and 12. A shaft sleeve 53 is associated with the knob 43 such that the shaft sleeve 53 fits over the push rod 31 when the knob 43 and associated shaft sleeve 53 are inserted into shaft 12. A knob-connecting collar 55 inserted into the shaft 12 fits around the shaft collar 53. A set screw 57 is inserted from the exterior of the handle 10, through the grip 41, through the shaft 12, and into the knob-connecting collar 55. As such, the set screw 57, holds the knob-connecting collar 55 in place within the interior of the shaft 12. When the knob 43 and associated shaft sleeve 53 are inserted into the shaft 12, the set screw 57 is aligned with a notch 59 circumscribed on the exterior of the shaft sleeve 53. With the set screw 57 in place within the notch 59, the knob 43 is held firmly in place on the terminus of the handle 10 and against the ball bearings 51. As such the knob 43 may freely rotate 360-degrees upon the ball bearings 51, the shaft sleeve 53 is allowed to also freely rotate within the shaft 12, and the knob 43 is kept from being pulled from the end of the handle 10.

Additionally, the shaft sleeve 53 has an interior diameter that allows the push rod 31 to pass through the shaft sleeve 53 such that knob 43 and shaft sleeve 53 may freely rotate about push rod 31. As shown in FIGS. 11A and 12, the button actuator 45 is recessed within the distal end surface 19. When in use, the knob 43 freely rotates about the button actuator 45 and push rod 31 without the risk of the user unintentionally depressing the button actuator 45 or the non-rotating button actuator 45 rubbing on the palm of the user's hand.

The quick-release handle 10 may be a part of a interchangeable system of working heads including socket mounts that accommodate the quick-release coupling assembly 20. The user would then be able to use a myriad of mop with the same handle 10 and thus reduce the storage clutter associated with each tool having its own handle. For example, the system may include a wet mop head 300 using the wet mop head mount 361 such as shown in FIGS. 1, 7A and 7B. Additionally, or alternatively, the system may include a variety of wet mop heads 300 using the same wet mop head mount 361, but with different types of mop substrates 301 or different sizes of mop substrates 301.

The system may also include the wet mop head as shown in FIG. 5. Such a wet mop head utilizes a simpler socket mount 463 than used in the previous examples. The socket mount 463 may attach a wet mop substrate 410 by the use of a substrate attachment collar 467. As shown in FIG. 5, the socket mount 463 may have holes inside the socket to act as a retention stop 65. The detent balls 27 of the coupling assembly 20 could then engage such holes to secure the wet mop head to the shaft 12 of the handle 10.

The scrubbing material 313 of the mob substrate 301 of the present invention may be nonwoven webs, woven webs, knitted webs, or laminates thereof, as are well-known in the art. The scrubbing material 313 can be made from a variety of processes including, but not limited to, air laying processes, wet laid processes, hydroentangling processes, spunbonding, meltblowing, staple fiber carding and bonding, and solution spinning. The fibers themselves can be made from a variety of both natural and synthetic materials including, but not limited to, cellulose, rayon, nylon, polyesters, polyolefins and many other materials. The fibers may be relatively short, staple length fibers, typically less than 3 inches, or longer and substantially more continuous fibers such as are produced by spunbonding and meltblowing processes.

An example of a material that may used for the scrubbing material 313 of the mop substrate 301 of the invention are the hydroentangled materials commonly used in such wipers and sold by the Kimberly-Clark Corporation, Roswell, Ga., as HYDROKNIT®. Examples of such hydroentangled materials are discussed in U.S. Pat. No. 5,284,703 to Everhart et al., U.S. Pat. No. 5,389,202 to Everhart et al., U.S. Pat. No. 6,103,061 to Anderson et al., and U.S. Pat. No. 6,784,126 to Everhart et al.

Generally, such a hydroentangled nonwoven composite fabric has about 1 to 30 percent, by weight, of a nonwoven fibrous web component and more than about 70 percent, by weight, of the fibrous component. More particularly, such nonwoven composite fabrics have about 10 to 25 percent, by weight, of the nonwoven fibrous web component and more than about 70 percent, by weight, of the fibrous component. The nonwoven fibrous web is typically a nonwoven fabric or web formed by meltblowing processes, spunbonding processes, bonded carded web processes or a similar process that forms a web having a structure of individual fibers or threads which are interlaid. Preferably, the polymeric fibers are made of polymers selected from the group including polyolefins, polyamides, polyesters, polycarbonates, polystyrenes, thermoplastic elastomers, fluoropolymers, vinyl polymers, and blends and copolymers thereof. The fibers of the fibrous material may be pulp fibers, natural non-woody fibers, synthetic fibers, or combinations thereof. A non-woody fiber source is any fiber species that is not a woody plant fiber source. Such non-woody fiber sources include, without limitation, seed hair fibers from milkweed and related species, abaca leaf fiber (also known as Manila hemp), pineapple leaf fibers, sabai grass, esparto grass, rice straw, banana leaf fiber, base (bark) fibers from paper mulberry, and similar fiber sources. Suitable synthetic fibers include polyolefins, rayons, acrylics, polyesters, acetates and other such staple fibers.

The scrubbing ability of the hydraulically entangled nonwoven composite fabric may be increased through embossing the fabric. Embossing such hydraulically entangled nonwoven composite fabrics may be done with a matched pair of embossing rolls (see U.S. Pat. No. 5,284,703 to Everhart et al.). Preferably, the composite fabric is also pre-heated just prior to entering the matched pair of embossing rolls to ensure a more resilient embossing pattern (see U.S. Pat. Publ. No. 2006/0128247 to Skoog et al.).

Preferably the hydraulically entangled nonwoven composite fabric that may be used in the mop substrate 301 of the present invention, may preferably have a basis weight of between about 64 and about 128 grams per squared meter. Such a composite desirably may use a spunbonded polypropylene web having a basis weight between about 11.87 and about 16.96 grams per squared meter as the nonwoven fibrous web and 100 percent northern softwood pulp as the fibrous material. The nonwoven fibrous web and fibrous material hydraulically entangled would be in a weight ratio of fibrous web to fibrous material of between about 85:15 to about 80:20.

Alternatively, the scrubbing materials 313 may be coform materials such as shown in U.S. Pat. No. 4,818,464 to Lau and U.S. Pat. No. 4,100,324 to Anderson et al. The scrubbing materials 313 may be spunbond materials as are well known in the art and as shown in U.S. Pat. No. 4,340,563 to Appel et al., and U.S. Pat. No. 3,692,618 to Dorschner et al. Other non-limiting examples of materials that can be used individually, or in combination with other materials, as the scrubbing materials 313 in the mop substrate 301 of the present invention are disclosed in U.S. Pat. No. 4,820,577 to Morman et al., U.S. Pat. No. 4,950,526 to Singleton, U.S. Pat. No. 5,350,624 to Georger et al., U.S. Pat. No. 6,331,230 to Hermans et al., U.S. Pat. No. 6,149,767 to Hermans et al., U.S. Pat. No. 6,177,370 to Skoog et al., U.S. Pat. No. 6,649,547 to Arnold et al., U.S. Pat. No. 6,692,825 to Qin et al., U.S. Pat. No. 6,736,916 to Steinke et al., U.S. Pat. No. 6,777,056 to Boggs et al., U.S. Pat. No. 6,797,360 to Varona, and U.S. Pat. No. 6,797,377 to DeLucia et al.

Additionally, structure, materials, or combinations thereof, may be added to the surface of the scrubbing layer 313 to improve the scrubbing capability of the mop substrate 301. Protrusions, ridges, embossments, bumps, or other texture may be provided to the surface of the scrubbing layer 313 by processing of the scrubbing material, or may be provided by an additional material added to the surface of the scrubbing layer 313. For example, bumps or ridges of silicone could be added to the surface of the scrubbing layer 313. The addition of such silicone texturing to a scrubbing surface is well known.

The absorbent foam layer 311 of the mop substrate 301 may be any absorbent foam material that can be laminated to the scrubbing layers 313 and is capable of giving the mop substrate 301 the mopping characteristics desired by the user. Absorbent foams are known in the art and are readily available. While not intending to be limiting, the absorbent foam may be preferably selected from the general classifications of absorbent thermoplastic foams and absorbent thermoset foams.

Absorbent thermoset foams are readily available and are well known. Non-limiting examples of such thermoset foams may include foams made from melamine, polyurethane, poly (vinyl chloride), rubber, latex, polyester, and the like. Such foams may be subjected to post-treatment steps or chemical treatments, as are well known, to increase the wettability of such foams. One skilled in the art would understand how the proper treatment method, extent of treatment, and the characteristic material properties of such foams could be balanced to meet the specific needs of the particular mop substrate 301. Examples of absorbent thermoset foams may be found in U.S. Pat. No. 3,650,995 to Erickson; U.S. Pat. No. 3,669,103 to Harper et al.; U.S. Pat. No. 3,900,030 to Bashan; U.S. Pat. No. 4,133,784 to Otey et al.; U.S. Pat. No. 4,174,415 to Bethe; U.S. Pat. No. 4,205,103 to Davis et al.; U.S. Pat. No. 4,337,181 to Otey et al.; U.S. Pat. No. 4,454,268 to Otey et al.; U.S. Pat. No. 4,717,738 to Fukuda et al.; U.S. Pat. No. 4,725,629 to Garvey et al.; U.S. Pat. No. 4,731,391 to Garvey; U.S. Pat. No. 4,985,467 to Kelly et al.; U.S. Pat. No. 5,011,864 to Nielsen et al.; and U.S. Pat. No. 5,110,843 to Bries et al.

Open-cell, thermoplastic absorbent foams that may be used in the mop substrate of the present invention may be made by forming a foam polymer formula that includes a plasticizing agent and one or more surfactants in combination with a base resin. The plasticizing agent included in the foam polymer formula may further increase the softness of the resulting foam and, optionally, to increase the open-cell content and cell size of the resulting foam. Examples of an open-cell, thermoplastic absorbent foams including their manufacture and use may be found in U.S. Patent Application No. 2006/0148917 to Radwanski et al.; U.S. Patent Application No. 2006/0030632 to Krueger et al.; U.S. Patent Application No. 2006/0068187 to Krueger et al.; U.S. Patent Application No. 2005/0228350 to Ranganathan et al.; and U.S. Patent Application No. 2005/0124709 to Krueger et al.

The foam of the invention possesses a number of desirable properties attributable to the balanced presence of both a plasticizing agent and surfactant. The inclusion of the surfactant and plasticizing agent in the foam polymer formula enhances softness, flexibility, absorbency, as well as the uniformity of cell-size distribution within the foam. As used herein, the term "foam polymer formula" refers to the composition of the foam during the foam-forming process, whereas the term "foam" refers to a finished or formed state of the foam.

The open-cell content of the foam, which can be controlled by adjusting the amount of surfactant and/or plasticizing agent included in the foam polymer formula, is suitably about 50% or greater, or about 70% or greater, or about 80% or greater, as measured using ASTM D2856. The foam is low density, with a density of about 0.10 gram/cubic centimeter ($g/cm^3$) or less, or about 0.07 $g/cm^3$ or less, or about 0.04 $g/cm^3$ or less and suitably at least about 0.02 $g/cm^3$ (before any compression is applied to meet specific packaging and/or in-use requirements), is soft and flexible, and is resilient. The foam density is a measurement of bulk density, determined using ASTM D1622. Softness, flexibility, elasticity, and resiliency are also demonstrated through compression set resistance. The foam of the invention suitably has a compression resistance of about 20% compression set or less, or about 15% compression set or less, or about 7% compression set or less, as measured using ASTM D3575.

The base resin, or starting material, included in the foam polymer formula used to make the thermoplastic foam that may be used in the absorbent foam layer 313 of the invention may include any suitable thermoplastic polymer, or blend of thermoplastic polymers, or blend of thermoplastic and non-thermoplastic polymers.

Examples of polymers, or base resins, suitable for use in the foam polymer formula include styrene polymers, such as polystyrene or polystyrene copolymers or other alkenyl aromatic polymers; polyolefins including homo or copolymers of olefins, such as polyethylene, polypropylene, polybutylene, etc.; polyesters, such as polyalkylene terephthalate; and combinations thereof. A commercially available example of polystyrene resin is Dow STYRON® 685D, available from Dow Chemical Company in Midland, Mich., U.S.A.

Coagents and compatibilizers can be utilized for blending such resins. Crosslinking agents can also be employed to enhance mechanical properties, foamability and expansion. Crosslinking may be done by several means including electron beams or by chemical crosslinking agents including organic peroxides. Use of polymer side groups, incorporation of chains within the polymer structure to prevent polymer crystallization, lowering of the glass transition temperature, lowering a given polymer's molecular weight distribution, adjusting melt flow strength and viscous elastic properties including elongational viscosity of the polymer melt, block copolymerization, blending polymers, and use of polyolefin homopolymers and copolymers have all been used to improve foam flexibility and foamability. Homopolymers can be engineered with elastic and crystalline areas. Syndiotactic, atactic and isotactic polypropylenes, blends of such and other polymers can also be utilized. Suitable polyolefin resins include low, including linear low, medium and high-density polyethylene and polypropylene, which are normally made using Ziegler-Natta or Phillips catalysts and are relatively linear; generally more foamable are resins having branched polymer chains. Isotactic propylene homopolymers and blends are made using metallocene-based catalysts. Olefin elastomers are included.

Ethylene and α-olefin copolymers, made using either Ziegler-Natta or a metallocene catalyst, can produce soft, flexible foam having extensibility. Polyethylene cross-linked with α-olefins and various ethylene ionomer resins can also be utilized. Use of ethyl-vinyl acetate copolymers with other polyolefin-type resins can produce soft foam. Common modifiers for various polymers can also be reacted with chain groups to obtain suitable functionality. Suitable alkenyl aromatic polymers include alkenyl aromatic homopolymers and copolymers of alkenyl aromatic compounds and copolymerizable ethylenically unsaturated comonomers including minor proportions of non-alkenyl aromatic polymers and blends of such. Ionomer resins can also be utilized.

Other polymers that may be employed include natural and synthetic organic polymers including cellulosic polymers, methyl cellulose, polylactic acids, polyvinyl acids, polyacrylates, polycarbonates, starch-based polymers, polyetherimides, polyamides, polyesters, polymethylmethacrylates, and copolymer/polymer blends. Rubber-modified polymers such as styrene elastomers, styrene/butadiene copolymers, ethylene elastomers, butadiene, and polybutylene resins, ethylene-propylene rubbers, EPDM, EPM, and other rubbery homopolymers and copolymers of such can be added to enhance softness and hand. Olefin elastomers can also be utilized for such purposes. Rubbers, including natural rubber, SBR, polybutadiene, ethylene propylene terpolymers, and vulcanized rubbers, including TPVs, can also be added to improve rubber-like elasticity.

Thermoplastic foam absorbency can be enhanced by foaming with spontaneous hydrogels, commonly known as superabsorbents. Superabsorbents can include alkali metal salts of polyacrylic acids; polyacrylamides; polyvinyl alcohol; ethylene maleic anhydride copolymers; polyvinyl ethers; hydroxypropylcellulose; polyvinyl morpholinone; polymers and copolymers of vinyl sulfonic acid, polyacrylates, polyacrylamides, polyvinyl pyridine; and the like. Other suitable polymers include hydrolyzed acrylonitrile grafted starch, acrylic acid grafted starch, carboxy-methyl-cellulose, isobutylene maleic anhydride copolymers, and mixtures thereof. Further suitable polymers include inorganic polymers, such as polyphosphazene, and the like. Furthermore, thermoplastic foam biodegradability and absorbency can be enhanced by foaming with cellulose-based and starch-based components such as wood and/or vegetable fibrous pulp/flour.

In addition to any of these polymers, the foam polymer formula may also, or alternatively, include diblock, triblock, tetrablock, or other multi-block thermoplastic elastomeric and/or flexible copolymers such as polyolefin-based thermoplastic elastomers including random block copolymers including ethylene α-olefin copolymers; block copolymers including hydrogenated butadiene-isoprene-butadiene block copolymers; stereoblock polypropylenes; graft copolymers, including ethylene-propylene-diene terpolymer or ethylene-propylene-diene monomer (EPDM), ethylene-propylene random copolymers (EPM), ethylene propylene rubbers (EPR), ethylene vinyl acetate (EVA), and ethylene-methyl acrylate (EMA); and styrenic block copolymers including diblock and triblock copolymers such as styrene-isoprene-styrene (SIS), styrene-butadiene-styrene (SBS), styrene-isoprene-butadiene-styrene (SIBS), styrene-ethylene/butylene-styrene (SEBS), or styrene-ethylene/propylene-styrene (SEPS), which may be obtained from Kraton Polymers of Belpre, Ohio, U.S.A., under the trade designation KRATON® elastomeric resin or from Dexco, a division of ExxonMobil Chemical Company in Houston, Tex., U.S.A., under the trade designation VECTOR® (SIS and SBS polymers) or SEBS polymers as the SEPTON® series of thermoplastic rubbers from Kuraray America, Inc. in New York, N.Y., U.S.A.; blends of thermoplastic elastomers with dynamic vulcanized elastomer-thermoplastic blends; thermoplastic polyether ester elastomers; ionomeric thermoplastic elastomers; thermoplastic elastic polyurethanes, including those available from E.I. Du Pont de Nemours in Wilmington, Del., U.S.A., under the trade name LYCRA® polyurethane, and ESTANE® available from Noveon, Inc. in Cleveland, Ohio, U.S.A.; thermoplastic elastic polyamides, including polyether block amides available from ATOFINA Chemicals, Inc. in Philadelphia, Pa., U.S.A., under the trade name PEBAX® polyether block amide; thermoplastic elastic polyesters, including those available from E.I. Du Pont de Nemours Company, under the trade name HYTREL®, and ARNITEL® from DSM Engineering Plastics of Evansville, Ind., U.S.A., and single-site or metallocene-catalyzed polyolefins having a density of less than about 0.89 grams/cubic centimeter such as metallocene polyethylene resins, available from Dow Chemical Company in Midland, Mich., U.S.A. under the trade name AFFINITY™; and combinations thereof.

As used herein, a tri-block copolymer has an ABA structure where the A represents several repeat units of type A, and B represents several repeat units of type B. As mentioned above, several examples of styrenic block copolymers are SBS, SIS, SIBS, SEBS, and SEPS. In these copolymers the A blocks are polystyrene and the B blocks are the rubbery component. Generally these triblock copolymers have molecular weights that can vary from the low thousands to hundreds of thousands and the styrene content can range from 5% to 75% based on the weight of the triblock copolymer. A diblock copolymer is similar to the triblock but is of an AB structure. Suitable diblocks include styrene-isoprene diblocks, which have a molecular weight of approximately one-half of the triblock molecular weight and having the same ratio of A blocks to B blocks. Diblocks with a different ratio of A to B blocks or a molecular weight larger or greater than one-half of triblock copolymers may be suitable for improving the foam polymer formula for producing low-density, soft, flexible, absorbent foam via polymer extrusion.

It may be particularly beneficial to include a thermoplastic elastomer having a high diblock content and high molecular weight as part of the foam polymer formula to extrude low-density, soft, flexible, resilient, absorbent, thermoplastic foam. For example, the thermoplastic elastomer may have a diblock content between about 50% and about 80%, by weight, of the total thermoplastic elastomer weight.

KRATON® products have been shown to act as a discontinuous phase in styrenic-based foams and act as cell-opener generators when used in small amounts. The amount of KRATON® polymers used in the foam polymer formula as a whole in the foam of the invention is of such a large magnitude that the cell-opener effect is negligible compared to the resiliency, flexibility, elasticity, and softness imparted.

Suitably, the foam polymer formula includes up to about 90%, by weight, of polystyrene, and at least 10%, by weight, of thermoplastic elastomer. More particularly, the foam polymer formula may include between about 45% and about 90%, by weight, of polystyrene, and between about 10% and about 55%, by weight, of thermoplastic elastomer. Alternatively, the foam polymer formula may include between about 50% and about 80%, by weight, of polystyrene, and between about 20% and about 50%, by weight, of thermoplastic elastomer.

In one embodiment, for example, the foam polymer formula may include equal amounts of polystyrene and thermoplastic elastomer.

In another embodiment, the foam polymer formula may include about 40% to about 80% by weight polystyrene and about 20% to about 60% by weight thermoplastic elastomer. In another embodiment, the foam polymer formula may include about 50% to about 70% by weight polystyrene and about 30% to about 50% by weight thermoplastic elastomer.

A plasticizing agent may be included in the thermoplasitc foam polymer formula. A plasticizing agent is a chemical agent that imparts flexibility, stretchability and workability. The type of plasticizing agent has an influence on foam gel properties, blowing agent migration resistance, cellular structure, including the fine cell size, and number of open cells. Typically plasticizing agents are of low molecular weight. The increase in polymer chain mobility and free volume caused by incorporation of a plasticizing agent typically results in a Tg decrease, and plasticizing agent effectiveness is often characterized by this measurement. Petroleum-based oils, fatty acids, and esters are commonly used and act as external plasticizing agents or solvents because they do not chemically bond to the polymer yet remain intact in the polymer matrix upon crystallization.

The plasticizing agent increases cell connectivity by thinning membranes between cells to the point of creating porous connections between cells; thus, the plasticizing agent increases open-cell content. Suitably, the plasticizing agent is included in an amount between about 0.5% and about 10%, or between about 1% and about 10%, by weight, of the foam polymer formula. The plasticizing agent is gradually and carefully metered in increasing concentration into the foam polymer formula during the foaming process because too much plasticizing agent added at once creates cellular instability, resulting in cellular collapse.

Examples of suitable plasticizing agents include polyethylene, ethylene vinyl acetate, mineral oil, palm oil, waxes, esters based on alcohols and organic acids, naphthalene oil, paraffin oil, and combinations thereof. A commercially available example of a suitable plasticizing agent is a small-chain polyethylene that is produced as a catalytic polymerization of ethylene; because of its low molecular weight it is often referred to as a "wax." This low-density, highly branched polyethylene "wax" is available from Eastman Chemical Company of Kingsport, Tenn., U.S.A., under the trade designation EPOLENE® C-10.

In order for such a thermoplastic foam to be used in personal care and medical product applications and many absorbent wiping articles and non-personal care articles, the foam must meet stringent chemical and safety guidelines. A number of plasticizing agents are FDA-approved for use in packaging materials. These plasticizing agents include: acetyl tributyl citrate; acetyl triethyl citrate; p-tert-butylphenyl salicylate; butyl stearate; butylphthalyl butyl glycolate; dibutyl sebacate; di-(2-ethylhexyl)phthalate; diethyl phthalate; diisobutyl adipate; diisooctyl phthalate; diphenyl-2-ethylhexyl phosphate; epoxidized soybean oil; ethylphthalyl ethyl glycolate; glycerol monooleate; monoisopropyl citrate; mono-, di-, and tristearyl citrate; triacetin (glycerol triacetate); triethyl citrate; and 3-(2-xenoyl)-1,2-epoxypropane.

In certain embodiments, the same material used as the thermoplastic elastomer may also be used as the plasticizing agent. For example, the KRATON® polymers, described above, may be used as a thermoplastic elastomer and/or a plasticizing agent. In which case, the foam polymer formula may include between about 10% and about 50%, by weight, of a single composition that acts as both a thermoplastic elastomer and a plasticizing agent. Described in an alternative manner, the foam may be formed without a plasticizing agent per se; in which case, the foam polymer formula may include between about 10% and about 50%, by weight, of the thermoplastic elastomer.

Foaming of soft, flexible polymers, such as thermoplastic elastomers, to a low density is difficult to achieve. The addition of a plasticizing agent makes foaming to low densities even more difficult to achieve. The method of the invention overcomes this difficulty through the inclusion of a surfactant in the foam polymer formula. The surfactant stabilizes the cells, thereby counteracting cellular collapse while retaining an open-cell structure. This stabilization of the cells creates cell uniformity and control of cell structure. In addition to enabling foaming of plasticized thermoplastic elastomer polymer containing foam formulations to low densities, the surfactant also provides wettability to enable the resulting foam to absorb fluid.

While it is not intended to limit the thermoplastic foam to a particular theory, it is believed that improved cell stabilization is achieved via the use of surfactant in a foam polymer formula containing a plasticizing agent. The addition of a plasticizing agent makes foaming to low densities even more difficult to achieve. Plasticizing agents such as waxes, oils, silicone defoamers, and small particulates at low addition provide localized surface tension reduction in the foam cell membrane, which causes rupturing and premature cellular collapse or coalescence. The method of the invention overcomes this difficulty through the addition of surfactant to the foam polymer formula which counteracts thermodynamic and kinetic instabilities of bubble formation in the polymer melt. The surfactant stabilizes the cells, thereby counteracting cellular collapse caused by the plasticizing agent. This stabilization of the cells creates cell uniformity in terms of cell size and cell size distribution and thereby allows control of cell structure. Since the surfactant is a surface active agent, it lowers the surface or interfacial tension and thus assists bubble formation. A decreased surface tension reduces the pressure differential required to maintain a bubble of a certain size, reduces the pressure difference between bubbles of different sizes, reduces the free energy required to maintain a given interfacial area, and thus increases the bubble nucleation rate. As Gibbs theorem explains, a surfactant combats excessive thinning of cell membranes and restores surfactant concentration to the surface and thereby acts as a stabilizing factor; however, a surfactant does not restore liquid to the film, which results in a lack of self-repair. The Marangoni effect describes surface flow of dragging underlying layers of liquid to restore film thickness, which enhances film elasticity and resilience and thus counters cellular coalescence. This again is a stabilizer. Assuming the credence of these two mechanisms, a surfactant would be most effective if it is designed so that the Marangoni effect dominates the foam polymer formula, for if the Gibbs effect dominates, the diffusion rate would be too high and self-repair would not occur. Therefore the addition of surfactant acts as a "buffer" or "stabilizer" to control surface tension and with control of temperature, which also affects surface tension, melt viscosity and melt strength, bubble stability can occur so that cells form in the thermoplastic melt. This effect is offset by lowering the surface tension forces that hold the polymer matrix together.

Bubble walls typically drain due to gravity and capillary forces. Such drainage thins the walls before the cell struts are sufficiently hardened, which leads to cell collapse. La Place and Young proposed that capillary pressure at the junction of two or more ribs is lower, thereby creating flow from the membrane to the ribs and, consequently, thinning. With a sufficient amount of surfactant molecules arranged preferentially to migrate to the surface of the film membrane, the presence of surfactant at the membrane's thin film surfaces provides resistance to drainage of the molten plastic. If the film layer is sufficiently thick, such as in a foam membrane, it can be further stabilized by an ionic double layer of molecules resulting from orientation of ionic surfactants. Both nonionic and ionic surfactants can exhibit another stabilizing force if the membrane is sufficiently thin. This would be done by the alignment of surfactant tails to create a bi-layer structure, such as found in biological cells, that is held together via Van der Waals forces and thus stabilizes the foam membrane.

(References: *Polymeric Foams*, edited by Daniel Klempner and Kurt Frisch, Hanser Publishers, 1991; and *Foam Extrusion*, edited by S. T. Lee, Technomic Publishing Co., Inc., 2000.)

The surfactant is thought to also provide resistance to diffusion of the gas from the cell to the surroundings, which also aids in resisting collapse. The reduced gas permeability due to the drainage resistance is related to the degree the surfactant can pack into the bubble's film surface and explains the difference between the performances of the various surfactants. This reduced rate of diffusion allows sufficient cooling for strut formation to prevent coalescence. The surfactant does not need to prevent drainage, but simply slows it sufficiently so that the cell struts are substantially hardened thereby preventing cell coalescence. In general terms, it is expected that surfactants that are highly mobile in the melt, highly surface active, and can pack tightly and prevent membrane drainage will provide the best cell stabilization.

The surfactant used in the thermoplastic foam formulation may be a single surfactant, or a multi-component surfactant system. A multi-component surfactant system is a combination of two or more surfactants. It has been found that certain multi-component surfactant systems can achieve equal or better foam formation at a lower dosage than certain single-component surfactant systems. Example 3, below, illustrates the effects of adding various dosages of surfactant and surfactant mixtures to a polymer blend. For example, in the samples tested, the two-component surfactant foams had densities comparable to foam made with over three times the amount of a single-surfactant system. Surfactant is a costly component in the foam polymer formula. The use of certain multi-component surfactant systems can be used to achieve foam having comparable foam properties at a lower cost than foam that includes three times as much surfactant.

The surfactant can be included in the foam polymer formula in an amount between about 0.05% and about 10%, or between about 0.1% and about 5%, by weight, of the foam polymer formula. In an embodiment in which the surfactant is a multi-component surfactant system, the total of all surfactants can be included in the foam polymer formula in an amount between about 0.05% and about 8.0%, or between about 0.1% and about 3.0%, by weight, of the foam polymer formula. Examples of suitable surfactants include cationic, anionic, amphoteric, and nonionic surfactants. Anionic surfactants include the alkylsulfonates. Examples of commercially available surfactants include HOSTASTAT® HS-1, available from Clariant Corporation in Winchester, Va., U.S.A.; Cognis EMEREST® 2650, Cognis EMEREST® 2648, and Cognis EMEREST® 3712, each available from Cognis Corporation in Cincinnati, Ohio, U.S.A.; and Dow Corning 193, available from Dow Chemical Company in Midland, Mich., U.S.A. Alkyl sulfonates are quite effective; however, use of this class of surfactants in certain applications may be limited because of product safety. Some combinations offer unexpected benefits where the alkyl sulfonate is added at a substantially lower level in conjunction with another surfactant to yield good foaming and wettability. In one embodiment, for example, the surfactant can be added to the foam polymer formula in a gaseous phase, such as through the use of a blowing agent such as supercritical carbon dioxide. One benefit of using a gaseous surfactant is that the surfactant can fully penetrate and be incorporated into the polymer matrix, which can improve substantivity and thereby reduce surfactant fugitivity to enhance the foam's permanent wettability.

The balance between cell stabilization of the surfactant and the enhanced melt drainage from the plasticizing agent enables control over the open-cell content of the resulting foam. More particularly, the amount of surfactant can be adjusted to counteract the effects of the plasticizing agent, and/or the amount of the plasticizing agent can be adjusted to counteract the effects of the surfactant. For example, if the plasticizing agent is included in the foam polymer formula in an amount between about 0.5% and about 5%, by weight, of the foam polymer formula, then the surfactant should be included in the foam polymer formula in an amount between about 0.5% and about 5%, by weight, of the foam polymer formula. Similarly, if the plasticizing agent is included in the foam polymer formula in an amount between about 5% and about 10%, by weight, of the foam polymer formula, then the surfactant should be included in the foam polymer formula in an amount between about 2% and about 10%, by weight, of the foam polymer formula. In addition, the polymer resin melt flow index can be adjusted to offset the plasticizing agent's effect.

Other additives can be included in the foam polymer formula to enhance the properties of the resulting thermoplastic foam. For example, a nucleant can be added to improve foam gas bubble formation in the foam polymer formula. Examples of suitable nucleants include talc, magnesium carbonate, nanoclay, silica, calcium carbonate, modified nucleant complexes, and combinations thereof. An example of a commercially available nucleant is a nanoclay available under the trade name CLOISITE® 20A, from Southern Clay Products, Inc. in Gonzales, Tex., U.S.A. The nucleant can be added to the foam polymer formula in an amount between about 0.1% and about 5%, by weight, of the foam polymer formula. Nucleants, or nucleating agents, are described in greater detail below.

A blowing agent, described in greater detail below, can be added to the foam polymer formula to aid in the foaming process. Blowing agents can be compounds that decompose at extrusion temperatures to release large volumes of gas, volatile liquids such as refrigerants and hydrocarbons, or ambient gases such as nitrogen and carbon dioxide, or water, or combinations thereof. A blowing agent can be added to the foam polymer formula in an amount between about 1% and about 10%, by weight, of the foam polymer formula.

Once the foam polymer formula is mixed and formed, including the plasticizing agent, the surfactant, and any other additives, the foam polymer formula is heated and mixed, suitably to a temperature between about 100 and about 500 degrees Celsius, to create a polymer melt. The plasticizing agent reduces elongational viscosity of the polymer melt, which leads to foaming difficulties. However, the surfactant mediates the impact of the plasticizing agent on the viscosity, thereby providing control over the open-cell content of the resulting foam. Also, as mentioned, the polymer resin melt index can be adjusted to offset the plasticizing agent's effect.

The polymer melt can be foamed using any suitable foaming technique known to those skilled in the art. The density of the foam is suitably about 0.35 g/cm$^3$ or less, or about 0.20 g/cm$^3$ or less, or about 0.10 g/cm$^3$ or less, for example, about 0.02 to about 0.10 g/cm$^3$. Foam expansion ratio is generally about 10 or greater. Suitably, the absorbent foam has about 5% or more closed cells, or about 10% or more closed cells, or about 15% or more closed cells to improve resiliency and/or compression resistance.

The polymer melt can be continuously extruded to form a soft, flexible, open-cell, thermoplastic, absorbent foam. As explained above, the open-cell content of the foam is controlled by adjusting the amounts of plasticizing agent and surfactant. Open-cell content can be measured using a gas pycnometer according to ASTM D2856, Method C. The open-cell content of the resulting foam is suitably about 50% or greater, or about 70% or greater, or about 80% or greater.

To produce thermoplastic foam, continuous plastic extrusion processes are typically utilized. (Certain injection molding and batch processes can also be employed.) Often tandem screw-type extruders are used because of the need for tight control of extrusion temperatures to produce open-cell foam. The first extruder typically contains several zones including: feed and conveying, compression, melting, metering and mixing zones and if one extruder is being used, a cooling zone is utilized prior to polymer melt discharge, foaming, and shaping. The first extruder is typically hopper loaded with resin and additives using dry/blend/metering equipment and/or having the additive(s) incorporated into the pelletized polymer concentrate such as in a masterbatch. The resins, additives, and/or masterbatch are then heated in the extruder to form a plasticized or melt polymer system, often with zoned temperature control using extruder cooling/heating systems. Physical blowing agents are typically added after the melt temperature has been heated to a temperature at or above its glass transition temperature or melting temperature to form a foamable melt. The inlet for a physical blowing agent is typically between the metering and mixing zones. The blowing agent is mixed thoroughly with the melted polymer at a sufficiently elevated pressure to prevent melt expansion. With a nucleating agent and blowing agent blended in the polymer melt, the foamable melt is typically cooled to a lower temperature to control the desired foam cell structure. With tandem extruders, the cooling is done in a second extruder which is connected downstream of the first extruder through a heated cross-over supply pipe. In single extruders, cooling is typically done upstream of the discharge orifice. Often cooling/heating systems with process temperature control loops are incorporated to tightly control foam bubble nucleation/growth within the melt. The optimum cooling temperature is typically at or slightly above the glass transition temperature or melting point of the melt.

Figure 13:
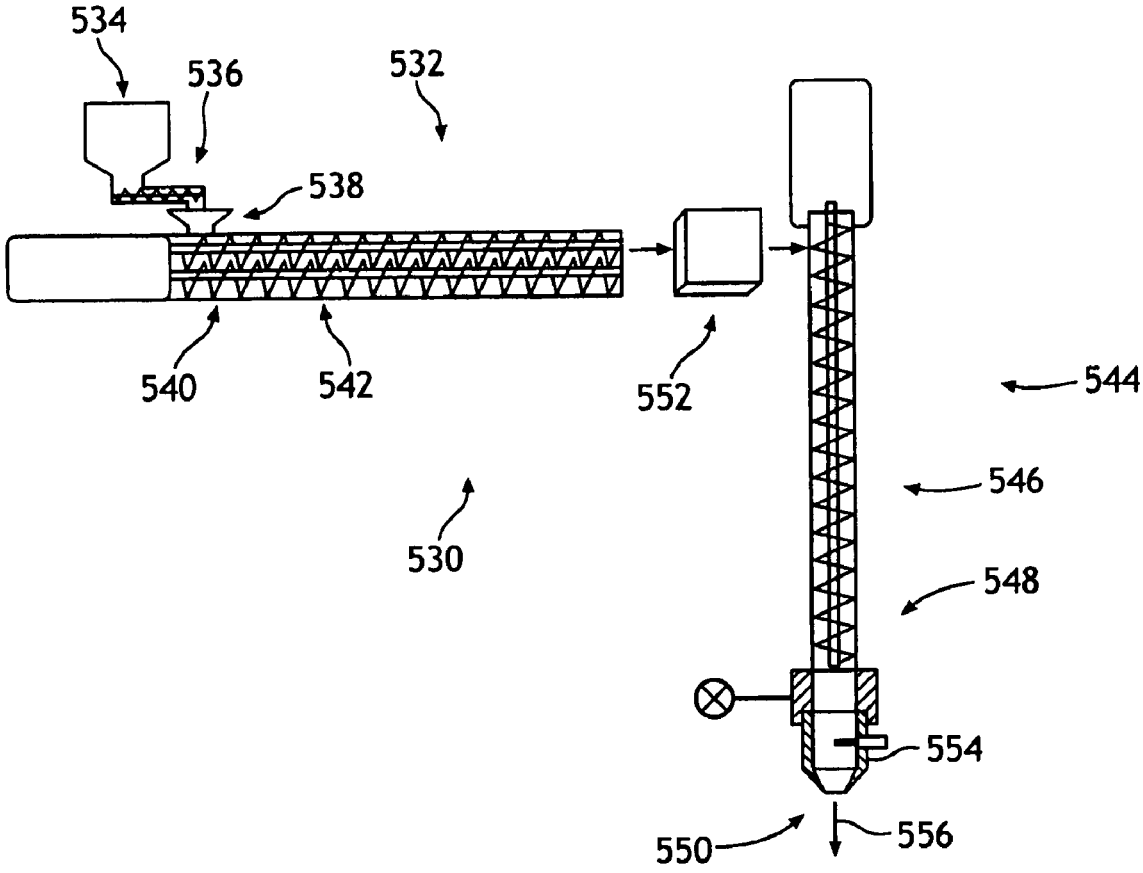
FIG. 13 is a schematic view of a tandem extrusion process useful to make the absorbent foam of the wet mop substrate.

In one embodiment, a tandem extruder, such as illustrated in FIG. 13, can be utilized. This type of extruder 530 may be considered particularly suitable in some aspects because it has the ability to provide tight control of extrusion temperatures to produce open-cell foam. With tandem extruders 530, the first extruder section 532 typically contains several zones including a feed zone 534, a conveying zone 536, a compression zone 538, a melting zone 540, and a metering and mixing zone 542. The second extruder section 544 often contains a cooling zone 546 and a shaping zone 548 prior to the discharge 550. The first extruder 532 is typically hopper loaded with the base resin(s) as well as any other desired additives, including thermoplastic elastomers, plasticizing agents, surfactants and/or fibers, for example. Techniques known in the art for accomplishing this include using dry blend/metering equipment and/or having the components incorporated into a palletized polymer concentrate such as in a masterbatch. The components of the foam formula are then heated in the extruder 532 to form a plasticized or melt polymer.

The foamable melt is then typically cooled to a lower temperature to control the desired foam cell structure. In the case of tandem extruders 530, the cooling is typically accomplished in the second extruder 544 which is connected downstream of the first extruder 532 through a heated cross-over supply pipe 552. In the case of single extruders (not shown), cooling is typically accomplished upstream of the discharge orifice. Often cooling/heating systems with process temperature control loops are incorporated to tightly control foam bubble nucleation/growth within the gas-laden melt. The optimum cooling temperature for foam formation is typically at or slightly above the glass transition temperature or melting point of the melt.

The melt is then extruded through a die 554 to a lower pressure (typically atmospheric or a vacuum) and lower temperature (typically ambient) environment to cause thermodynamic instability and foaming which then cools and crystallizes the plastic to form a stabilized foam 556 which then solidifies to form a web or layer. Often circular, annular or slit dies, including curtain dies, and the like are used, often with a mandrel, to shape and draw the web to the desired gauge, shape, and orientation with foam expansion and cooling.

Various equipment configurations using such extrusion means can be used to manufacture the thermoplastic foam that may be used as the absorbent foam layer 313 of the present invention. In addition, various specialized equipment can be employed upstream of specially designed dies to enhance mixing, cooling, cellular structure, metering, and foaming. Such equipment includes static mixers, gear pumps, and various extruder screw designs, for example. Stretching equipment, including roller nips, tenters, and belts, may also be used immediately downstream of the discharge to elongate cellular shape to enhance absorbency, for example. Microwave irradiation for cross-linking, foaming activation, and mechanical means can also be used to enhance foam properties. Foam contouring, shaping (e.g., use of a wire mesh pattern) and the like, using thermoforming, and other such thermal processes, including thermal bonding, can be used to control shaping, flexibility, softness, aesthetics, and absorbent swelling.

Both physical and chemical blowing agents, including both inorganic and organic physical blowing agents, are used to create foaming. Suitable inorganic physical blowing agents include water, nitrogen, carbon dioxide, air, argon, and helium. Organic blowing agents include hydrocarbons such as methane, ethane, propane, butanes, pentanes, hexanes, and the like. Aliphatic alcohols and halogenated hydrocarbons, including FREON® and HFC-134A, can also be used though in the latter, their use is generally avoided for environmental reasons. Endothermic and exothermic chemical blowing agents which are typically added at the extruder hopper include: azodicarbonamide, paratoluene sulfonyl hydrazide, azodiisobutyro-nitrile, benzene sulfonyl hydrazide, P-toluene sulfonyl hydrazide, barium azodicarboxylate, sodium bicarbonate, sodium carbonate, ammonium carbonate, citric acid, toluene solfonyl semicarbazide, dinitroso-pentamethylene-tetramine, phenyltetrazole sodium borohydride, and the like. Mixtures and combinations of various physical and chemical blowing agents can be used and often are used to control cell structure. Blowing agent activators can be added to lower the decomposition temperature/profile of such chemical blowing agents. Such activators include metals in the form of salts, oxides, or organometallic complexes.

Open-cell formation can be regulated by elevated processing pressures and/or temperatures and use of nucleating agents and chemical blowing agents which can control both cell density and cell structure. Various base resins are sometimes used to broaden the foaming temperature to make open-cell foam. Open-cell level can be facilitated by adding small amounts of various immiscible polymers to the foam polymer formula such as adding polyethylene or ethylene/vinyl acetate copolymer to polystyrenic-based foam systems to create interphase domains that cause cell wall rupture. By regulating the polymer system components and crystallization initiating temperature, open-cell content and microporous cell membrane uniformity can be controlled. Ethylene-styrene interpolymers can be added to alkenyl aromatic polymers to control open-cell quality and improve surface quality and processability. Small amounts of polystyrene-based polymers are sometimes added to polyolefin-based foams to increase open-cell content.

Additives, such as nucleating agents, can also be employed to obtain desired fine open-cell structure. The amount of nucleating agent will vary according to the cell structure desired, foaming temperature, pressure, polymer composition, and type of nucleating agent utilized. Typically with increasing nucleating agent, cell density and open-cell content increase. Nucleating agents include calcium carbonate, blends of citric acid and sodium bicarbonate, coated citric acid/sodium bicarbonate particles, nanoclays, silica, barium stearate, diatomaceous earth, titanium dioxide, talc, pulverized wood, clay, and calcium stearate. Stearic acid, salicylic acid, fatty acids, and metal oxides can also be used as foaming aids. Other thermoplastic polymers can also be used for such purposes. These are typically dry blended or added with the polymer concentrate.

Various additives such as lubricants, acid scavengers, stabilizers, colorants, adhesive promoters, fillers, smart-chemicals, foam regulators, various UV/infrared radiation stabilizing agents, antioxidants, flame retardants, smoke suppressants, anti-shrinking agents, thermal stabilizers, rubbers (including thermosets), anti-statics, permeability modifiers, and other processing and extrusion aids including mold release agents, and anti-blocking agents, and the like can also be added to the foam polymer formula.

Secondary, or post-treatment, processes can be performed to improve, among other things, absorbency, cellular orientation, aesthetics, softness, and similar properties. This can be accomplished through numerous techniques known in the art including mechanical needling and other mechanical perforation (such as to soften foam and increase open-cell content), stretching and drawing (such as for cellular orientation and softening), calendering or creping (such as to soften and rupture cell membranes to improve cellular intercommunication), brushing, scarfing, buffing/sanding, and thermoforming (such as to shape the foam composite). Often a foam surface skin may form during extrusion, which can later be skived or sliced off, needle-punched, brushed, scraped, buffed, scarved, sanded, or perforated to remove the barrier. Depending on the specific usage of the foam, application of a surfactant after the foaming process or needling process may further be utilized to afford a desired wettability.

Figure 14:
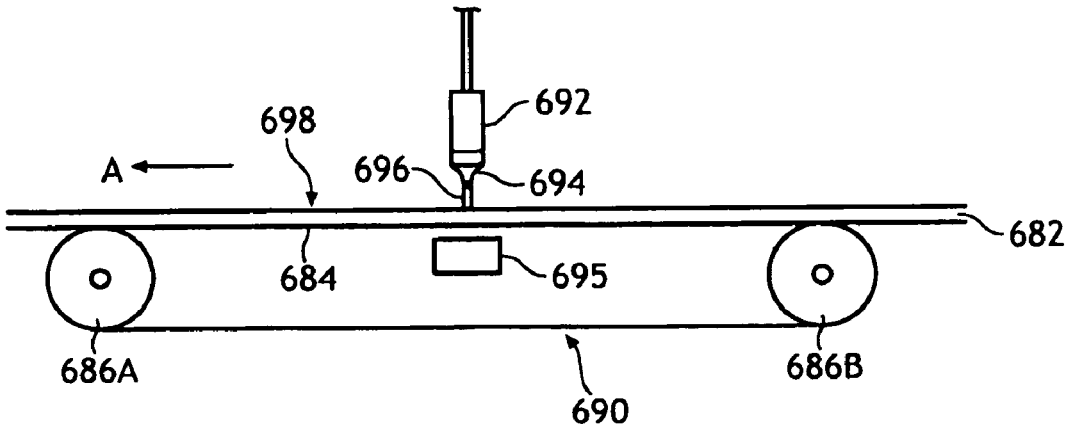
FIG. 14 is a schematic view of a post-treatment process for the absorbent foam of the wet mop substrate.

FIG. 14 illustrates one exemplary process for hydraulically needling a thermoplastic foam layer. In this example, a foam layer 682 is supported on an apertured foraminous support or carrier belt 684 of a hydraulic needling machine 690. The carrier belt 684 is supported on two or more rolls 686A and 686B provided with suitable driving means (not shown) for moving the belt 684 forward continuously. The carrier belt 684 may, for example, be a single plain weave foraminous wire having a mesh size from about 20 to about 150. Alternatively, a perforated plate (not shown) can be utilized as a backing carrier.

The foam layer 682 is then passed under one or more manifolds 692. The hydraulic needling process may be carried out with any appropriate working fluid such as, for example, water. The working fluid is generally evenly distributed by the manifold 692 through a series of individual holes or orifices 694 which may be from about 0.003 to about 0.015 inch (0.076 to 0.381 mm) in diameter. In some aspects, the working fluid passes through the orifices 694 at a pressure generally ranging from about 50 to about 3000 pounds per square inch gage (psig) (344 to 20685 KPa), such as about 60 to about 1500 psig (414 to 10342 KPa) or about 100 to about 800 psig (686 to 5516 KPa), or even about 200 to about 600 psig (1379 to 4137 KPa). In general, thermoplastic foam layers may utilize a fluid pressure ranging from about 60 to about 400 psig (414 to 2758 KPa), when one to four manifolds are used. However, greater needling energy may also be desired or required for high basis weight materials, stiffer modulus, higher line speeds, and the like.

Water jet treatment equipment and other hydraulic needling equipment and processes which may be adapted can be found, for example, in U.S. Pat. No. 3,485,706 to Evans, and in an article by Honeycomb Systems, Inc. entitled "Rotary Hydraulic Entanglement of Nonwovens," reprinted from INSIGHT 86 INTERNATIONAL ADVANCED FORMING/BONDING CONFERENCE, both of which are incorporated herein by reference in a manner consistent herewith. In some aspects, the invention may be practiced using a manifold containing a strip having 0.007 inch diameter orifices, 30 orifices per inch and one row of orifices such as that produced by Metso Paper USA, Inc., a business having offices located in Biddeford, Me., U.S.A. Other manifold configurations and combinations such as those available from Fleissner GmbH, a business having offices in Egelsbach, Germany or Rieter Perfojet S. A., a business having offices located in Winterthur, Switzerland, may also be used. For instance, in some aspects a single manifold may be utilized, whereas in other aspects several manifolds may be arranged in succession.

The resulting columnar jetted streams 696 of the working fluid impact on the foam layer 682, thereby puncturing the skin which may have formed on the foam layer surface during formation, and increasing the open-cell content of the layer. Additionally, vacuum slots in a suction box(es) 695 may be located directly beneath the hydraulic needling manifold(s) 694 and beneath the carrier belt 684 as well as downstream of the needling manifold(s) 694 to remove excess water from the hydraulically jet-treated material 698. The hydraulically jet-treated foam layer 698 can then be dried using means known in the art.

Calendaring and creping can also be used to soften and rupture cell membranes to improve cellular connectivity, and thermoforming can be used to shape the foam absorbent. Mechanical, hydraulic, thermal, or laser perforation can also be used to soften foam and further increase open-cell content. Post-densification of the foam structure, after extrusion, can be employed to enhance functionality.

By regulating the degree of hydraulic needling, calendaring, creeping, or any other post-treatment affecting open-cell formation, the level of absorbency and liquid release may be controlled for the material. One skilled in the art could see how such a variables, along with basis weight, could be used to obtain the capacity and rate that may be desired for the particular needs of a specific absorbent foam layer 313. The absorbent foam layer 313 of the present invention may be a thermoplastic absorbent foam having a basis weight between about 83 and about 112 grams per squared meter.

The mop assembly of the present invention may include additional functionality by the addition of various functional substances to the mob substrate 301 of the invention. Any substance that is typically used, either commercially or domestically, in combination with a cleaning tool may be pre-loaded into the mob substrate 301. Thus, instead of using a separate substance along with their mop, duster, or wiper, the user could use a cleaning tool utilizing a substrate 301 of the present invention that is pre-loaded with such a substance. The pre-loaded substrates could then be used to clean a surface or transfer such substances to the surface.

For example, a floor wax could be incorporated into the absorbent foam substrate. Rather than adding a floor wax to a mop bucket, the pre-loaded mop substrate 301 could be attached to a mop handle 10, and the user could wax the floor by transfer of the floor wax out of the mop substrate 301. This is but one example of how such functional substance may be used; others are possible. Additionally, such substances may be delivered from the substrate through rubbing the substrate on the surface, by applying pressure to the substrate, be activated through use of the substrate in combination with water, or other similar method.

Non-limiting examples of such functional substances may include cleaning solutions, soaps, degreasers, disinfectants, sanitizers, antibacterial substances, glass cleaner, surface-protective wax, surface polish, insecticide, or the like. More specifically, the functional substances may optionally contain effective amounts of surface cleaning agents such as quaternary compounds, proton donating antibacterial/cleaning agents, hydrophobic antibacterial/cleaning agents, chlorine stabilized cleaning agents, peroxide based cleaning agents, natural surfactants, and the like. Other such compositions as are known in the art for cleaning, protecting or improving surfaces may also be likewise pre-loaded on the mop substrate 301.

Such functional substances may be added to the surface of or incorporated into either of the scrubbing layers, added to the surface of or incorporated into the absorbent foam layer, positioned between the layers, or any combination thereof. Numerous well-known methods are available for the addition of such substances to the substrate. By way of non-limiting example, the substances may be added by spray coating, slot coating, brush coating, saturation, dip-and-squeeze, and the like. Similarly, the substance may also be microencapsulated and added to the substrate.

Additionally, as discussed above the absorbent foam, the scrubbing material, and the bonding configuration used to bond the layers together may also be balanced to provide a desired metering of such a functional substance from the substrate. By controlling the open-cell content, the basis weight, and the post-treatment of the foam, one skilled in the art would understand that the amount of functional substance and the speed that it was released from such an absorbent foam could be designed appropriately.

Regarding the scrubbing material, the basis weight, porosity, materials used, and the like, could also be balanced to allow the functional substance to be used and/or transferred to the desire surface upon which the substrate is being used. The substance is considered "transferably" in that at least a portion of the substance present within the substrate would be transferred from the substrate to the surface upon which the substrate is being used.

Finally, as discussed previously, the bonding method used to bond the scrubbing and absorbent foam layers together has an impact on the speed and the amount of functional substance that may be delivered out of the absorbent foam layer 313. For example, if the substrate is bonded in the center, such as illustrated in FIG. 4, the functional substance could be delivered quickly to the desired surface on which the substrate is being used. If it desired that a functional substance included with the absorbent foam layer 313 should be metered out at a slower rate, a bonding configuration such as illustrated in FIG. 3 may be appropriate.

One skilled in the art can see how the materials used and the bonding pattern that joins the layers together could be balanced and configured to provide a functional substance in the amount, and at the rate, that the user desires.

It will be appreciated that the foregoing examples and discussion, given for purposes of illustration, are not to be construed as limiting the scope of this invention, which is defined by the following claims and all equivalents thereto.

We claim:

1. A multi-layer laminate substrate strip adapted for use with a cleaning article, the multi-layer laminate substrate strip comprising:

a strip comprising a pair of opposed strip side edges, a pair of opposed strip end edges, a first side, a second side, and an absorbent foam layer, wherein the first side comprises a first layer of scrubbing material and a first face of the strip, the first face configured to be positioned against a surface, wherein the second side comprises a second layer of scrubbing material and a second face of the strip, the second face configured to be positioned against a surface, wherein the absorbent foam layer is positioned between the first side and the second side such that the first face and the second face of the strip are outwardly facing, wherein the first layer, the absorbent foam layer and the second layer are joined together by at least one or more bonds positioned between the opposing strip side edges such that portions of the absorbent foam layer are exposed at the strip side edges, and wherein the one or more bonds extend from the strip end edge and centrally along the substrate strip.

2. The substrate strip of claim 1, wherein the first layer of scrubbing material comprises a nonwoven material.

3. The substrate strip of claim 2, wherein the first layer of scrubbing material comprises a high pulp content hydraulically entangled nonwoven composite fabric, the composite fabric comprising from about 1 to about 25 percent, by weight, of a continuous filament nonwoven fibrous web and more than about 70 percent, by weight, of a fibrous material consisting of pulp fibers.

4. The substrate strip of claim 1, wherein the absorbent foam layer comprises an open-cell, absorbent thermoplastic foam.

5. The substrate strip of claim 1, wherein the absorbent foam layer comprises an absorbent thermoset foam.

6. The substrate strip of claim 1, wherein at least one of the first layer of scrubbing material, the absorbent foam layer, and the second layer of scrubbing material further comprises a functional substance, wherein the functional substance is configured to be transferable to a surface.

7. The substrate strip of claim 6, wherein the functional substance is selected from the group comprising a surfactant, a soap, a cleanser, a degreaser, a disinfectant, a sanitizer, a surface-protective wax, a glass cleaner, a surface polish, and an insecticide.

8. A cleaning article comprising:

a plurality of substrate strips;

a handle; and a head mount configured to couple with the handle, wherein the plurality of the strips are coupled with the head mount, wherein each of the strips of the plurality comprise a pair of opposed strip side edges, a pair of opposed strip end edges, a first side, a second side, and an absorbent foam layer, wherein the first side comprises a first layer of scrubbing material and a first face of the strip, the first face configured to be positioned against a surface, wherein the second side comprises a second layer of scrubbing material and a second face of the strip, the second face configured to be positioned against a surface, wherein the absorbent foam layer is positioned between the first side and the second side such that the first face and the second face of the strip are outwardly facing, and wherein the first layer, the absorbent foam layer and the second layer are joined together by at least one or more bonds positioned between the opposing strip side edges such that portions of the absorbent foam layer are exposed at the strip side edges.

9. The cleaning article of claim 8, wherein each of the plurality of strips comprises a mounting surface positioned centrally between the opposed strip end edges, wherein the mounting surface of each of the plurality of strips is configured to be coupled with the head mount.

10. The cleaning article of claim 9, wherein the plurality of strips are configured such that the mounting surfaces of each of the strips are superimposed.

11. The cleaning article of claim 9, wherein the plurality of strips are positioned next to each other and aligned side by side along strip side edges thereof, and wherein the mounting surfaces of the plurality of strips are aligned.

12. The cleaning article of claim 9, wherein the first layer of scrubbing material, the absorbent foam layer, and the second layer of scrubbing material of each of the substrate strips are joined together by one or more bonds extending transversely between the opposed strip end edges, the bonds positioned centrally between the opposed strip side edges of each of the substrate strips.

13. The cleaning article of claim 8, wherein first layer of scrubbing material comprises a nonwoven material.

14. The cleaning article of claim 13, wherein the first layer of scrubbing material comprises a high pulp content hydraulically entangled nonwoven composite fabric, the composite fabric comprising from about 1 to about 25 percent, by weight, of a continuous filament nonwoven fibrous web and more than about 70 percent, by weight, of a fibrous material consisting of pulp fibers.

15. The cleaning article of claim 8, wherein the absorbent foam layer comprises an open-cell, absorbent thermoplastic foam.

16. The cleaning article of claim 8, wherein the absorbent foam layer comprises an absorbent thermoset foam.

17. The cleaning article of claim 8, wherein at least one of the first layer of scrubbing material, the absorbent foam layer, and the second layer of scrubbing material further comprises a functional substance, wherein the functional substance is configured to be transferable to a surface.

18. The cleaning article of claim 17, wherein the functional substance is selected from the group comprising a surfactant, a soap, a cleanser, a degreaser, a disinfectant, a sanitizer, a surface-protective wax, a glass cleaner, a surface polish, and an insecticide.

* * * * *

UNITED STATES PATENT AND TRADEMARK OFFICE

CERTIFICATE OF CORRECTION

PATENT NO. : 7,624,468 B2
APPLICATION NO. : 11/458110
DATED : December 1, 2009
INVENTOR(S) : Reddy et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 9 days.

Signed and Sealed this

Twenty-sixth Day of October, 2010

David J. Kappos

David J. Kappos
*Director of the United States Patent and Trademark Office*